US011530593B1

(12) United States Patent
Mueller et al.

(10) Patent No.: US 11,530,593 B1
(45) **Date of Patent: *Dec. 20, 2022**

(54) STRIPPER HEAD SYSTEM AND METHOD OF USE

(71) Applicant: Mueller Rental, Inc., Yorktown, TX (US)

(72) Inventors: Harvey Mueller, Yorktown, TX (US); Jeremy Kneese, Yorktown, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/143,049

(22) Filed: Jan. 6, 2021

Related U.S. Application Data

(63) Continuation-in-part of application No. 16/273,114, filed on Feb. 11, 2019, now Pat. No. 10,914,130.

(60) Provisional application No. 62/628,677, filed on Feb. 9, 2018.

(51) Int. Cl.
*E21B 33/08* (2006.01)
*E21B 33/06* (2006.01)
*E21B 33/12* (2006.01)

(52) U.S. Cl.
CPC ..... *E21B 33/08* (2013.01); *E21B 33/06* (2013.01); *E21B 33/1208* (2013.01)

(58) Field of Classification Search
CPC ..... E21B 33/06; E21B 33/03; E21B 33/1208; E21B 33/1212; E21B 33/12
See application file for complete search history.

(56) References Cited

U.S. PATENT DOCUMENTS

| | | | | |
|---|---|---|---|---|
| 3,285,352 | A * | 11/1966 | Hunter | E21B 33/085 175/214 |
| 4,500,094 | A | 2/1985 | Biffle | |
| 5,178,215 | A | 1/1993 | Yenulis | |
| 5,647,444 | A | 7/1997 | Nilliams | |
| 5,848,643 | A | 12/1998 | Carbaugh | |
| 6,530,430 | B2 | 3/2003 | Reynolds | |
| 8,991,484 | B2 | 3/2015 | Riggs | |
| 9,840,898 | B2 | 12/2017 | Hughes | |
| 10,914,130 | B1 * | 2/2021 | Mueller | E21B 33/085 |
| 2018/0371840 | A1 * | 12/2018 | Cummins | E21B 23/02 |

* cited by examiner

*Primary Examiner* — Yong-Suk (Philip) Ro
(74) *Attorney, Agent, or Firm* — Shannon Warren

(57) ABSTRACT

A stripper head assembly for holding back pressure while stripping a work-string from pressurized well environment is disclosed. The stripper head assembly comprises a stripper head, a stripper insert, a stripper rubber, one or more retention bushing assemblies, one or more retention pins, and one or more retention apertures. The stripper head comprises an outer portion of the stripper head assembly. The stripper head comprises, from top to bottom, a top portion, a body portion, a lower neck portion and a flange base. A portion of the stripper insert fits within a portion of the stripper rubber. A portion of the stripper rubber fits within a portion of the stripper head.

20 Claims, 15 Drawing Sheets

STRIPPER HEAD SYSTEM AND METHOD OF USE

CROSS-REFERENCE TO RELATED APPLICATIONS

This application claims benefit to US Patent Application Number(s) 62/628,677 filed on Feb. 9, 2018, and U.S. Pat. No. 16,273,114 filed on 2019 Feb. 11.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

Prior art cited in the parent application to this filing include: US 20150376970 A1, U.S. Pat. Nos. 6,530,430 B2, 5,848,643 A, 5,647,444 A, U.S. Pat. No. 5,178,215 A, US 2013 0032359 A1, and U.S. Pat. No. 4,500,094 A.

In one embodiment, a stripper head assembly 100 can be used to hold back pressure while stripping work-strings in and out of pressurized well environments. Said stripper head assembly 100 can also aid in wellsite operations including horizontal drill-outs, rig assisted snubbing, reverse circulation, and sonic stimulation.

BRIEF SUMMARY OF THE INVENTION

A stripper head assembly for holding back pressure while stripping a work-string in and out of a pressurized well environment. Said stripper head assembly comprises a stripper head, a stripper insert, a stripper rubber, one or more retention bushing assemblies, one or more retention pins, and one or more retention apertures. Said stripper head comprises an outer portion of said stripper head assembly. Said stripper head comprises, from top to bottom, a top portion, a body portion, a lower neck portion and a flange base. a portion of said stripper insert fits within a portion of said stripper rubber. a portion of said stripper rubber fits within a portion of said stripper head. a portion of one or more bolts attach said flange base of said stripper head assembly equipment attached to a well head at said pressurized well environment, such as a blow-out preventer. Said stripper rubber comprises a rubber material. Each among said one or more retention bushing assemblies are configured to seal a retention pin cavity within said one or more retention apertures and around a portion of said one or more retention pins. Said one or more retention pins are configured to hold said stripper head assembly in place relative to said work-string. Each among said one or more retention bushing assemblies comprises one or more retention bushings, one or more grease ports, and a bleeder hole. Said bleeder hole allow a portion of a lubricant within said retention pin cavity to selectively escape at a given pressure. Said one or more grease ports are configured to selectively receive said lubricant into said retention pin cavity. Each among said one or more retention bushings comprises a ring comprising an interior O-ring groove, an exterior O-ring groove, a center aperture, a grease aperture, and said bleeder hole. Said interior O-ring groove and said exterior O-ring groove is configured to each be configured to contain a second O-ring and a third O-ring, as illustrated. Said second O-ring is configured to seat into said exterior O-ring groove and create a seal between said one or more retention bushing assemblies and a portion of said stripper head. Said third O-ring is configured to seat into said interior O-ring groove and create a seal between said one or more retention bushing assemblies and a portion of said one or more retention pins.

Said stripper head assembly for holding back pressure while stripping said work-string in and out of said pressurized well environment. Said stripper head assembly comprises said stripper head, said stripper insert, said stripper rubber, said one or more retention bushing assemblies, said one or more retention pins, and said one or more retention apertures. Said stripper head comprises an outer portion of said stripper head assembly. Said stripper head comprises, from top to bottom, said top portion, said body portion, said lower neck portion and said flange base. a portion of said stripper insert fits within a portion of said stripper rubber. a portion of said stripper rubber fits within a portion of said stripper head. a portion of said one or more bolts attach said flange base of said stripper head assembly equipment attached to said well head at said pressurized well environment, such as said blow-out preventer. Said stripper rubber comprises a rubber material. Each among said one or more retention bushing assemblies are configured to seal said retention pin cavity within said one or more retention apertures and around a portion of said one or more retention pins. Said one or more retention pins are configured to hold said stripper head assembly in place relative to said work-string.

Said stripper head assembly for holding back pressure while stripping said work-string in and out of said pressurized well environment. Said stripper head assembly comprises said stripper head, said stripper insert, said stripper rubber, said one or more retention bushing assemblies, said one or more retention pins, and said one or more retention apertures. Said stripper head comprises an outer portion of said stripper head assembly. Said stripper head comprises, from top to bottom, said top portion, said body portion, said lower neck portion and said flange base. a portion of said stripper insert fits within a portion of said stripper rubber. a portion of said stripper rubber fits within a portion of said stripper head. a portion of said one or more bolts attach said flange base of said stripper head assembly equipment attached to said well head at said pressurized well environment, such as said blow-out preventer. Said stripper rubber comprises a rubber material. Each among said one or more retention bushing assemblies are configured to seal said retention pin cavity within said one or more retention apertures and around a portion of said one or more retention pins. Said one or more retention pins are configured to hold said stripper head assembly in place relative to said work-string. Each among said one or more retention bushing assemblies comprises said one or more retention bushings. Each among said one or more retention bushings comprises a ring comprising said interior O-ring groove, said exterior O-ring groove, said center aperture. Said interior O-ring groove and said exterior O-ring groove is configured to each be configured to contain said second O-ring and said third O-ring, as illustrated. Said second O-ring is configured to seat into said exterior O-ring groove and create a seal between said one or more retention bushing assemblies and a portion of said stripper head. Said third O-ring is configured to seat into said interior O-ring groove and create a seal between said one or more retention bushing assemblies and a portion of said one or more retention pins. Said one or more retention pins are configured to selectively slide into said one or more retention apertures and selectively attach thereto by screwing an external threading of said one or more retention pins into an internal threading of said one or more retention apertures.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
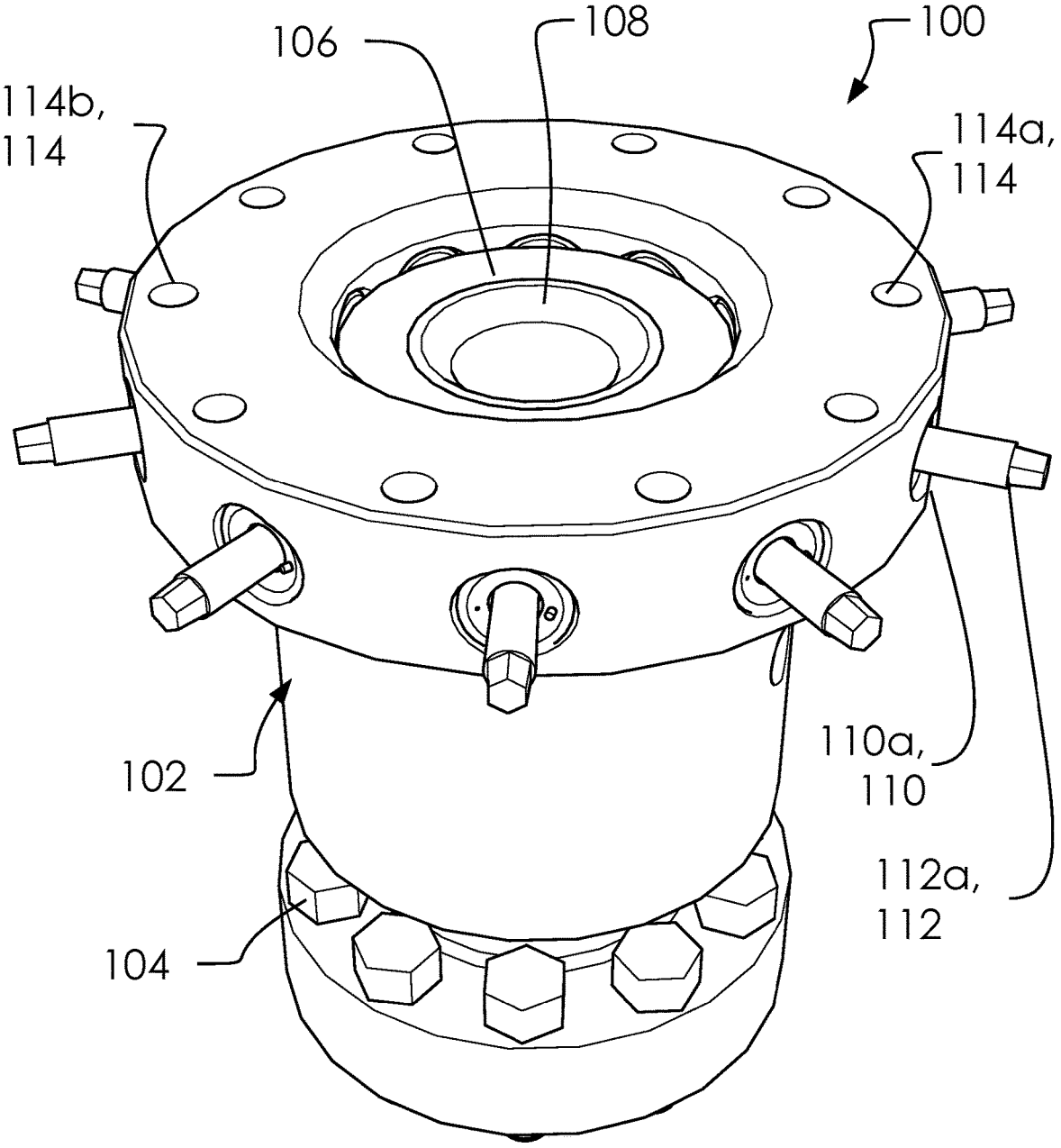
FIG. 1 illustrates an elevated overview view of a stripper head assembly 100.

FIG. 1 illustrates an elevated overview vie w of a stripper head assembly 100.

In one embodiment, said stripper head assembly 100 can comprise a stripper head 102, one or more bolts 104, a stripper insert 106, one or more retention bushing assemblies 110, a stripper rubber 108, one or more retention pins 112, and a one or more mating apertures 114.

In one embodiment, said one or more bolts 104 can comprise a first bolt 104*a*, a second bolt 104*b*, a third bolt 104*c*, a fourth bolt 104*d*, a fifth bolt 104*e*, a sixth bolt 104*f*, a seventh bolt 104*g*, an eighth bolt 104*h*, a ninth bolt 104*k* and a tenth bolt 104*m*.

In one embodiment, said one or more retention bushing assemblies 110 can comprise a first retention bushing assembly 110*a*, a second retention bushing assembly 110*b*, a third retention bushing assembly 110*c*, a fourth retention bushing assembly 110*d*, a fifth retention bushing assembly 110*e*, a sixth retention bushing assembly 110*f*, a seventh retention bushing assembly 110*g*, an eighth retention bushing assembly 110*h*, a ninth retention bushing assembly 110*k* and a tenth retention bushing assembly 110*m*.

In one embodiment, said one or more retention pins 112 can comprise a first retention pin 112*a*, a second retention pin 112*b*, a third retention pin 112*c*, a fourth retention pin 112*d*, a fifth retention pin 112*e*, a sixth retention pin 112*f*, a seventh retention pin 112*g*, an eighth retention pin 112*h*, a ninth retention pin 112*k* and a tenth retention pin 112*m*.

In one embodiment, said one or more mating apertures 114 can comprise a first mating aperture 114*a*, a second mating aperture 114*b*, a third mating aperture 114*c*, a fourth mating aperture 114*d*, a fifth mating aperture 114*e*, a sixth mating aperture 114*f*, a seventh mating aperture 114*g*, an eighth mating aperture 114*h*, a ninth mating aperture 114*k* and a tenth mating aperture 114*m*. In one embodiment, said one or more mating apertures 114 can be used to mate said stripper head assembly 100 with equipment such as a snubbing unit, hooks for lifting or similar.

As illustrated, only said first retention bushing assembly 110*a* is labeled. However, others among said one or more retention bushing assemblies 110 are illustrated throughout the figures and are arranged in a rotary pattern around said stripper head 102. Likewise, only said first retention pin 112*a* among said one or more retention pins 112 is illustrated, and said first mating aperture 114*a* and said second mating aperture 114*b* among said one or more mating apertures 114 are illustrated.

In one embodiment, said stripper head assembly 100 can be used to hold back pressure while stripping work-strings in and out of pressurized well environments. Said stripper head assembly 100 can also aid in wellsite operations including horizontal drill-outs, rig assisted snubbing, reverse circulation, and sonic stimulation. In one embodiment, said stripper head assembly 100 can fit to a snubbing unit, as is known in the art.

Said one or more retention pins 112 can be threaded. In one embodiment, said one or more retention pins 112 can be configured to hold said stripper head assembly 100 in place.

Said stripper head assembly 100 can be designed and built to meet API 16A.

Said stripper head assembly 100 can comprise said stripper rubber 108. Said stripper rubber 108 can comprise a self-energized seal that becomes reinforced as wellbore pressure increases within the pressure rating range.

Figure 2A:
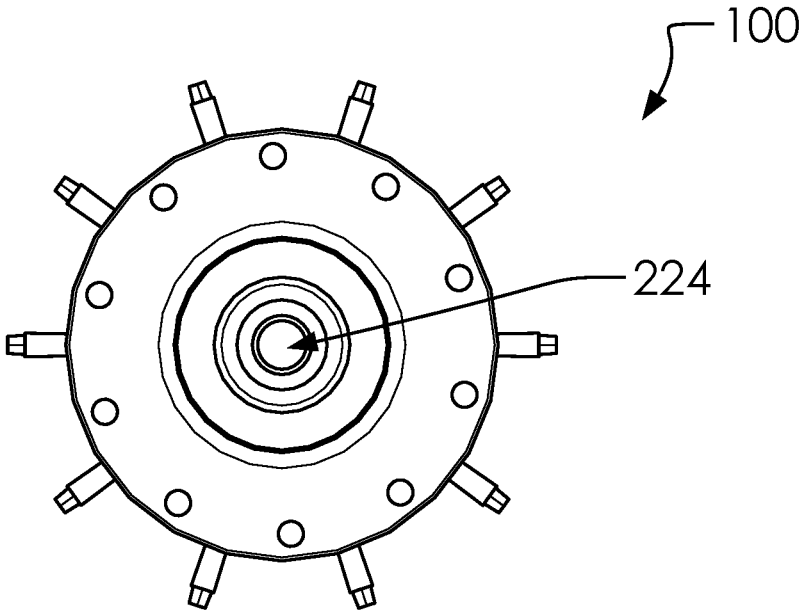
FIGS. 2A and 2B illustrate an elevated top side view and an elevated front side view of said stripper head assembly 100.
Figure 2B:
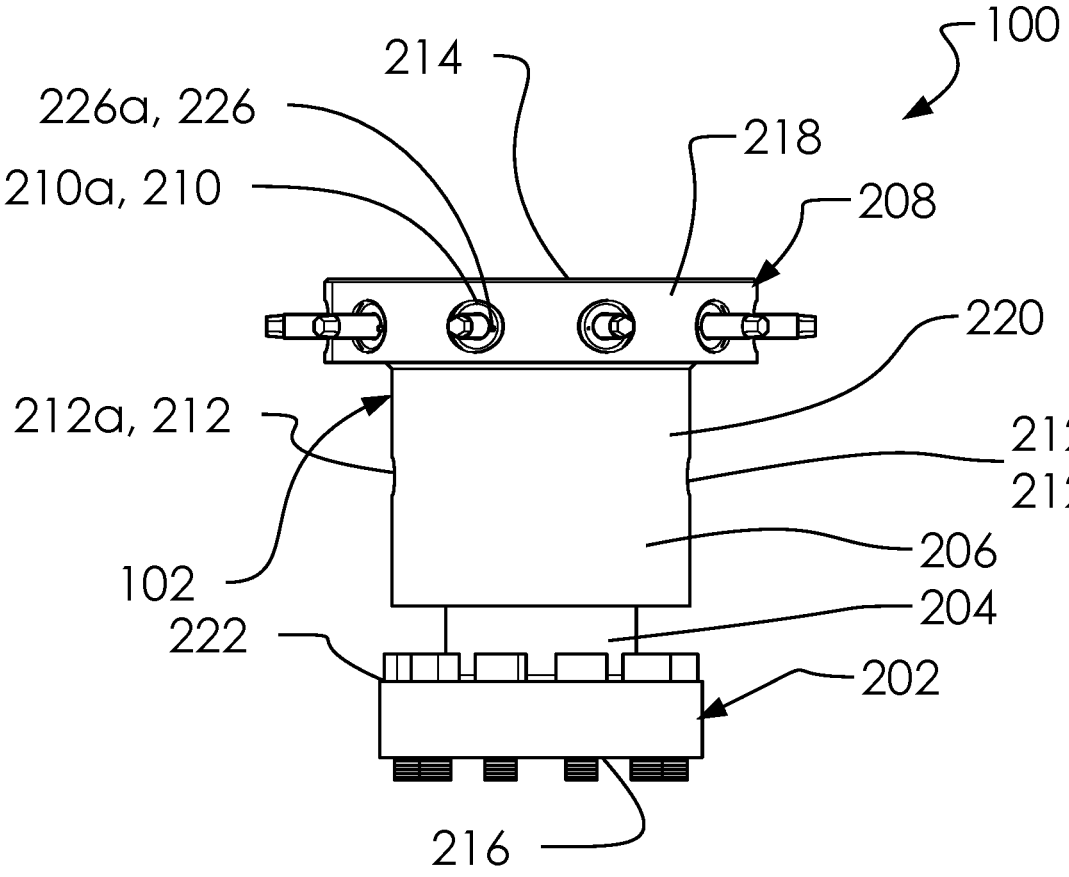

FIGS. 2A and 2B illustrate an elevated top side view and an elevated front side view of said stripper head assembly 100.

In one embodiment, a flange base 202 can comprise a bottom surface 216 and a top surface 222.

In one embodiment, a body portion 206 can comprise one or more flanged outlets 212 and a side surface 220.

In one embodiment, a top portion 208 can comprise one or more retention apertures 210, a top surface 214 and one or more grease ports 226.

Said one or more retention apertures 210 can comprise a first retention aperture 210*a*, a second retention aperture 210*b*, a third retention aperture 210*c*, a fourth retention aperture 210*d*, a fifth retention aperture 210*e*, a sixth retention aperture 210*f*, a seventh retention aperture 210*g*, an eighth retention aperture 210*h*, a ninth retention aperture 210*k* and a tenth retention aperture 210*m*.

In one embodiment, said one or more flanged outlets 212 can comprise a first flanged outlet 212*a* and a second flanged outlet 212*b*. In one embodiment, said one or more flanged outlets 212 can be arranged around said side surface 220 of said stripper head 102. In one embodiment, said one or more flanged outlets 212 can be used for pressure equalization and bleed-off.

Said one or more grease ports 226 can comprise a first grease port 226*a*, a second grease port 226*b*, a third grease port 226*c*, a fourth grease port 226*d*, a fifth grease port 226*e*, a sixth grease port 226*f*, a seventh grease port 226*g*, an eighth grease port 226*h*, a ninth grease port 226*k* and a tenth grease port 226*m*.

In one embodiment, said one or more grease ports 226 can comprise a part within said one or more retention bushing assemblies 110.

In one embodiment, said stripper head 102 can comprise an outer portion of said stripper head assembly 100. Said stripper head 102 can comprise, from top to bottom, said top portion 208, said body portion 206, a lower neck portion 204 and said flange base 202. In one embodiment, said stripper head 102 can comprise a series of substantially cylindrical parts being adapted for use as a snubbing unit, as is known in the art.

As illustrated, only a portion of said one or more retention apertures 210 and said one or more grease ports 226 are labeled. However, each are arranged around a center aperture 224 in a rotary pattern wherein, each unlabeled part can be determined by a person in the art.

Figure 3:
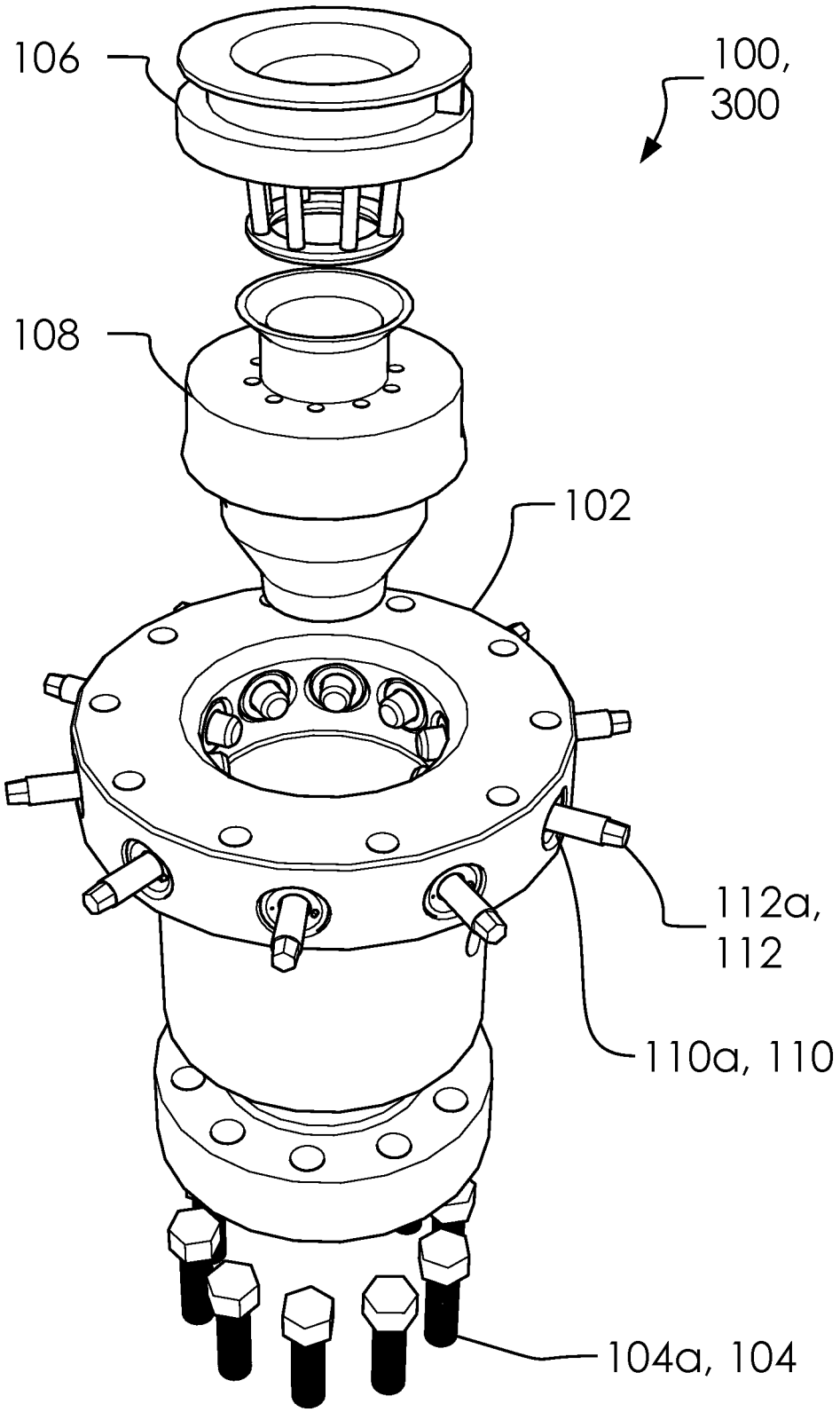
FIG. 3 illustrates a perspective overview view of said stripper head assembly 100 exploded.

FIG. 3 illustrates a perspective overview view of said stripper head assembly 100 exploded.

As illustrated, said stripper head assembly 100 can comprise several components which selectively nest within one another. For example, in one embodiment, a portion of said stripper insert 106 can fit within a portion of said stripper rubber 108; a portion of said stripper rubber 108 can fit within a portion of said stripper head 102; a portion of said one or more bolts 104 can attach to a portion of said stripper head 102; a portion of said one or more retention bushing assemblies 110 fit within a portion of said stripper head 102; and a portion of said one or more retention pins 112 fit within a portion of said one or more retention bushing assemblies 110.

In one embodiment, said stripper insert 106 can be molded into said stripper rubber 108. In one embodiment, these parts can be bonded together through an injected rubber molding process. In one embodiment, these can be bonded through injection transfer, compression, or molding process.

In one embodiment, said stripper head 102, said one or more bolts 104, said one or more retention bushing assemblies 110 and said one or more retention pins 112 can be constructed of metals such as steel. In one embodiment, said stripper rubber 108 can comprise rubber.

Figure 4A:
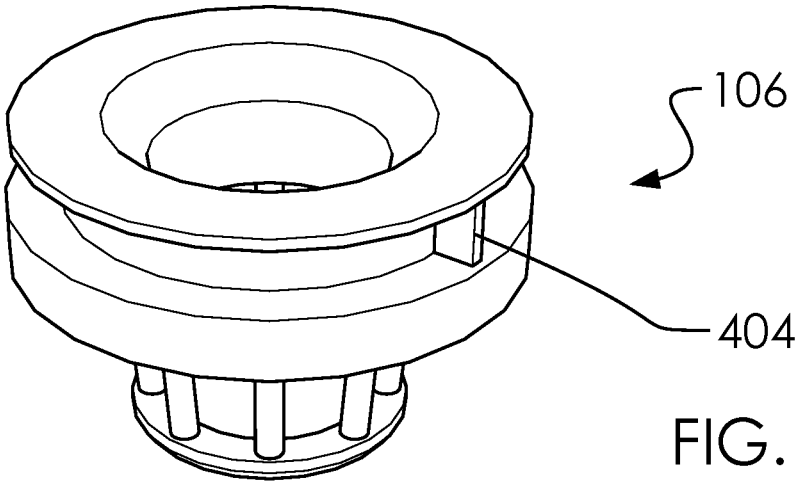
FIGS. 4A, 4B and 4C illustrate an elevated top side view, a perspective bottom side view and a perspective overview of a stripper insert 106.
Figure 4B:
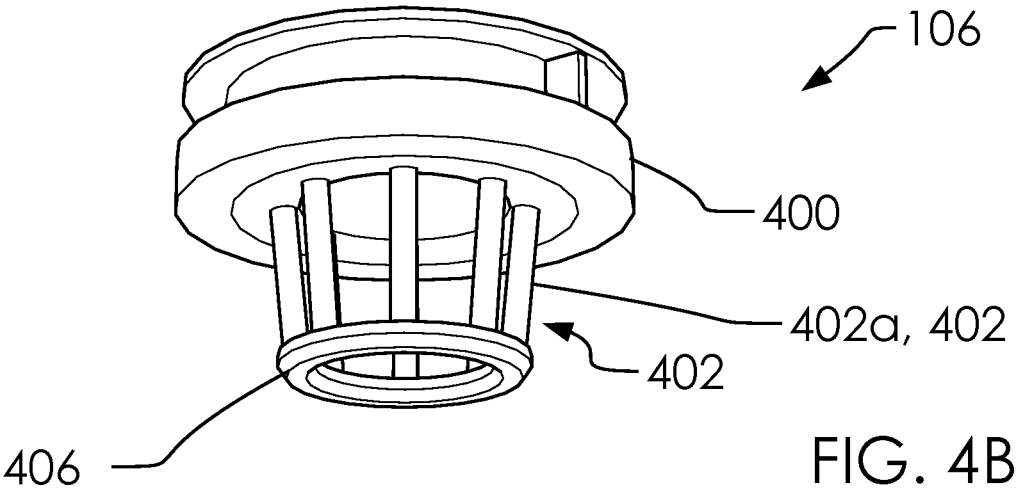
Figure 4C:
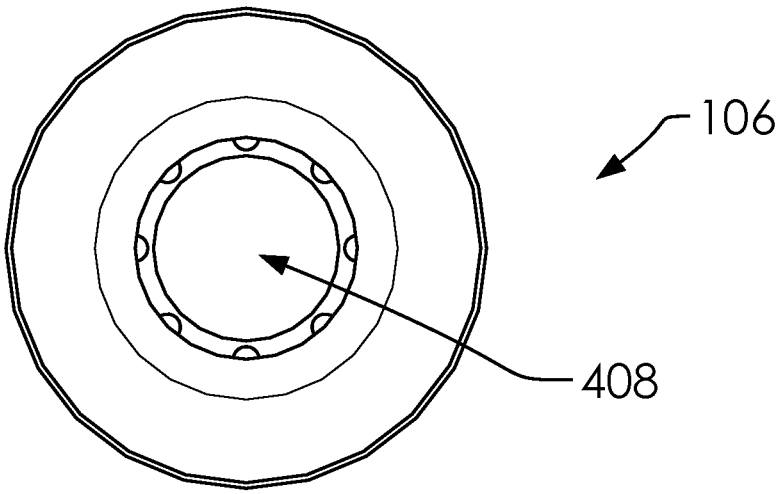

FIGS. 4A, 4B and 4C illustrate an elevated top side view, a perspective bottom side view and a perspective overview of said stripper insert 106.

In one embodiment, one or more stalks 402 can comprise a first stalk 402*a*, a second stalk 402*b*, a third stalk 402*c*, a fourth stalk 402*d*, a fifth stalk 402*e*, a sixth stalk 402*f*, a seventh stalk 402*g* and an eighth stalk 402*h*.

From top to bottom, said stripper insert 106 can comprise an insert upper ring 400, said one or more stalks 402, and an insert lower ring 406.

In one embodiment, said stripper insert 106 can fit within a portion of said stripper rubber 108; wherein, said one or more stalks 402 and said insert lower ring 406 can nest within said stripper rubber 108 as described and illustrated herein.

In one embodiment, said one or more stalks 402 can comprise cylindrical elements expending down from a lower portion of said insert upper ring 400. In one embodiment, said insert lower ring 406 can comprise a portion of said insert upper ring 400 having been cut away. In one embodiment, said insert lower ring 406 can comprise a substantially circular element adapted to prevent movement of said stripper insert 106 relative to said stripper rubber 108 once attached thereto.

In one embodiment, said insert upper ring 400 can comprise an anti-rotation tab 404 adapted to prevent rotation of said stripper insert 106 with a portion of said one or more retention pins 112 inserted into a portion of said insert upper ring 400.

In one embodiment, said stripper insert 106 can comprise a center aperture 408, as illustrated.

In one embodiment, said insert upper ring 400, said one or more stalks 402, said anti-rotation tab 404 and said insert lower ring 406 can be welded to one another.

Figure 5A:
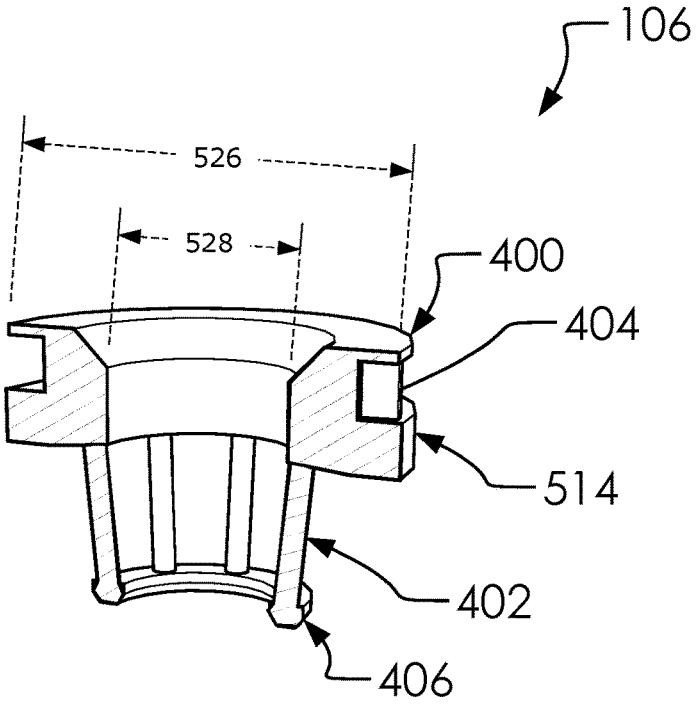
FIGS. 5A and 5B illustrate a cross-section elevated front side view and perspective overview of said stripper insert 106.
Figure 5B:
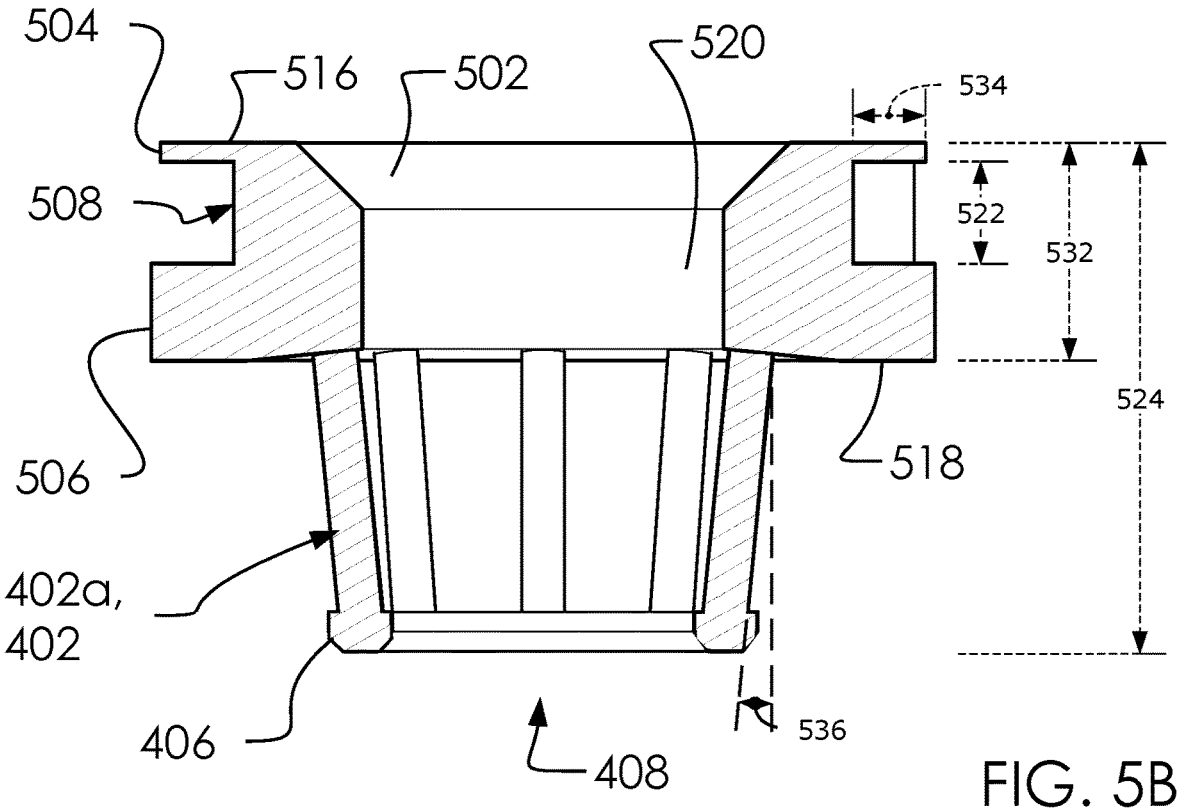

FIGS. 5A and 5B illustrate a cross-section elevated front side view and perspective overview of said stripper insert 106.

Said insert upper ring 400 can comprise a substantially cylindrical shape with said center aperture 408 cutting through a horizontal central axis. Said insert upper ring 400 can comprise an outer sidewall 514, a top surface 516, a bottom surface 518, an inner sidewall 520, and a height 532. In one embodiment, said outer sidewall 514 can comprise an indention 508 having a height 522 and a depth 534. In one embodiment, said outer sidewall 514 can be divided into an upper portion 504, a lower portion 506 and said indention 508; wherein, said indention 508 can comprise a disc shaped cut out of said insert upper ring 400 between said upper portion 504 and said lower portion 506, as illustrated.

In one embodiment, said center aperture 408 of said insert upper ring 400 can comprise a beveled interior edge 502 at a surface between said top surface 516 and said inner sidewall 520. In one embodiment, said top surface 516 can be substantially horizontal, and said inner sidewall 520 can be substantially vertical.

In one embodiment, said center aperture 408 can comprise an internal diameter 528; and said insert upper ring 400 can comprise an external diameter 526.

In one embodiment, said insert upper ring 400 can comprise a cylindrical ring defined by said outer sidewall 514, said top surface 516, said bottom surface 518 and said inner sidewall 520. Said beveled interior edge 502 can comprise an angular cut into said inner sidewall 520 between said top surface 516 and said inner sidewall 520. Said indention 508 can comprise a cut into said outer sidewall 514 to define said indention 508 with said upper portion 504 above said indention 508 and said lower portion 506 below said indention 508.

Said anti-rotation tab 404 can be inserted into a portion of said indention 508 to block off a portion of said indention 508. In one embodiment, a plurality of said anti-rotation tab 404 can be used, as needed. In one embodiment, said anti-rotation tab 404 can be welded into a portion of said indention 508.

In one embodiment, said insert lower ring 406 can be attached to said insert upper ring 400 with said one or more stalks 402 fixed at rotary intervals there-between.

In one embodiment, said one or more stalks 402 can attach to said bottom surface 518 at one end and said insert lower ring 406 at another end.

In one embodiment, said center aperture 408 can extend through said inner sidewall 520 and an inner sidewall 530 of said insert lower ring 406.

In one embodiment, said one or more stalks 402 can be arranged at a stalk angle 536 inward and down toward said center aperture 408 to provide an interference fit of said stripper head assembly 100 when no pressure is applied to the system and to provide a press said stripper rubber 108 in ward when under pressure.

Figure 6A:
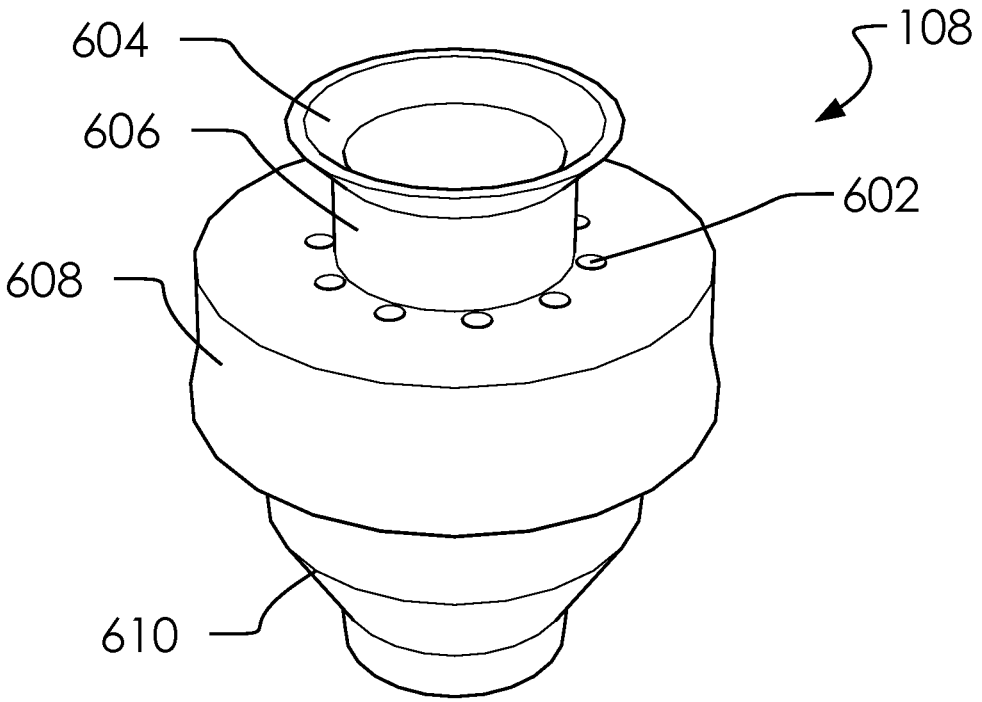
FIGS. 6A and 6B illustrate a perspective overview view and an elevated top side view of a stripper rubber 108.
Figure 6B:
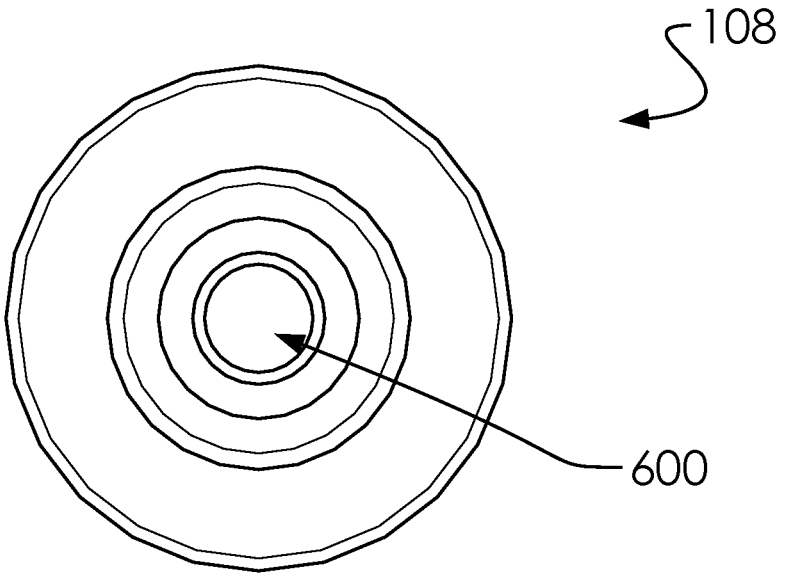

FIGS. 6A and 6B illustrate a perspective overview view and an elevated top side view of said stripper rubber 108.

Said stripper rubber 108 can comprise a rubber material for sealing parts of said stripper head assembly 100.

Said stripper rubber 108 can comprise one molded item with several features which can comprise (listed from top to bottom): a collar portion 604, an upper mid portion 606, a lower mid portion 608 and a lower portions 610. Said stripper rubber 108 can comprise a center aperture 600 to allow fluids to pass through said stripper rubber 108.

In one embodiment, said stripper rubber 108 can comprise a series of substantially cylindrical parts being arranged at various diameters to fill spaces within said stripper head 102 and said stripper insert 106 as discussed herein.

A stalks aperture 602 can comprise a space which (if assembled), said stripper insert 106 would be molded into said stripper rubber 108.

Figure 7A:
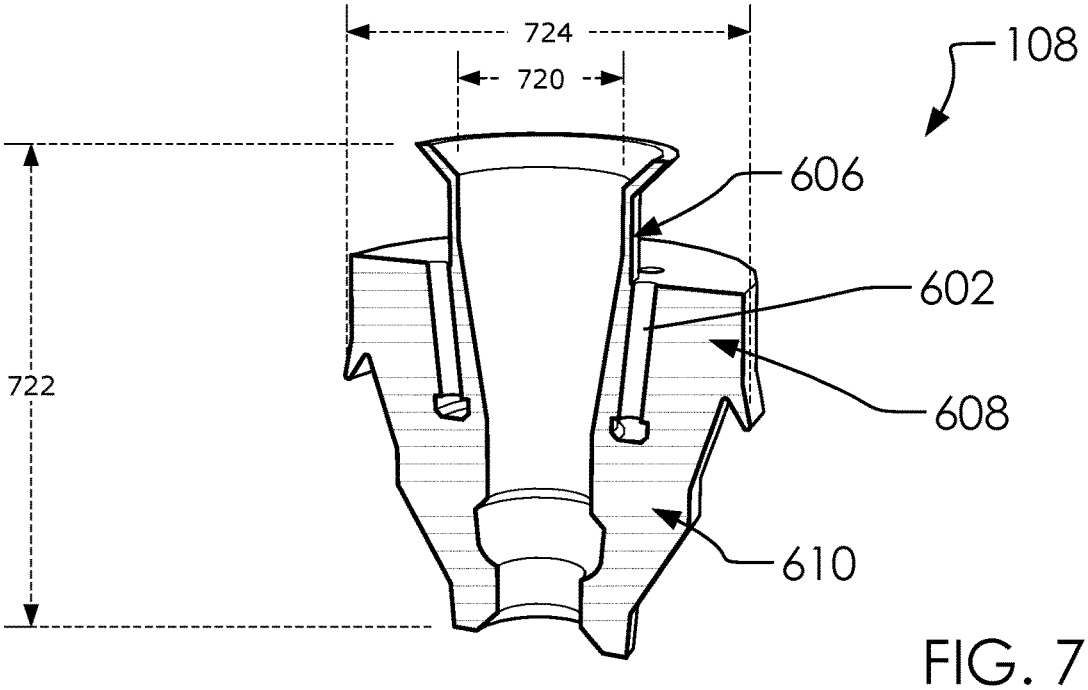
FIGS. 7A and 7B illustrate a perspective overview view in cross-section view and an elevated front side view of said stripper rubber 108
Figure 7B:
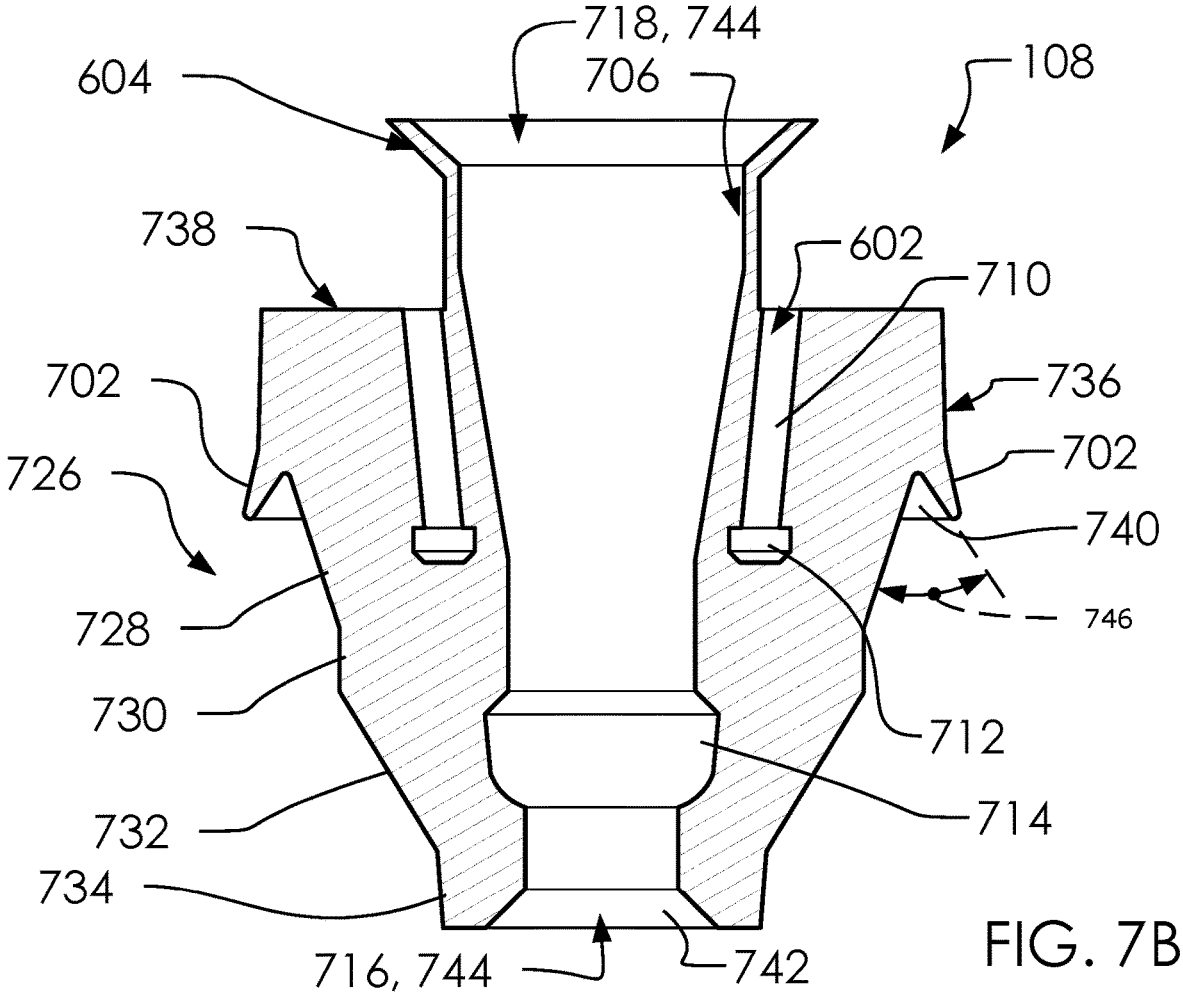

FIGS. 7A and 7B illustrate a perspective overview view in cross-section view and an elevated front side view of said stripper rubber 108

Said stripper rubber 108 can comprise a central aperture 744 along a horizontal central axis. Said central aperture 744 can comprise a lower aperture 716 and an upper aperture 718.

In one embodiment, said collar portion 604 of said stripper rubber 108 can comprise a diameter 720 at said upper aperture 718. In one embodiment, said collar portion 604 can flare out and upward away from said upper mid portion 606, as illustrated.

In one embodiment, said upper mid portion 606 of said stripper rubber 108 can comprise wrap around a portion of said stripper insert 106.

Said stalks aperture 602 can be formed by molding said one or more stalks 402 into said stripper rubber 108.

In one embodiment, said stripper rubber 108 can comprise a form fitting element for use within said stripper head assembly 100 being defined with said lower aperture 716 and said upper aperture 718 at either end of said center aperture 600; an inner surface 706 around an interior space comprising said center aperture 600; said collar portion 604 attaching to said upper mid portion 606; said upper mid portion 606 comprising a substantially cylindrical hollow element for selectively being held within said inner sidewall 520 of said stripper insert 106; a lubrication groove 714 cut into a portion of said lower portions 610; a shoulder 738 extending out from said upper mid portion 606 to form said lower mid portion 608; a seal lip 702 comprising an outwardly extending material comprising a pressure trap 740 between said lower mid portion 608 and said lower portions 610; said lower portions 610 extending down toward said lower aperture 716 and forming a multi-stage loading zones 726; and said multi-stage loading zones 726 configured to directing pressures so as to enhance the seal of said stripper rubber 108 within said stripper head assembly 100.

In one embodiment, said pressure trap 740 can comprise an internal taper 746. In one embodiment, said internal taper 746 can create an early seal with an internal surface 1202 of said stripper head 102. In this manner, said pressure trap 740 can be self-energized to press said seal lip 702 into said internal surface 1202. In one embodiment, said seal lip 702 can have enough initial contact to create the initial seal which can then hold. Self-energized can mean that said stripper rubber 108 need not be compressed or squeezed at installation to create the initial seal, rather it need only be inserted into said stripper head 102.

Existing systems are designed only to hold up to 2500 psi of pressure, whereas, said stripper head assembly 100 can hold many times more than that. Many design advantages are seen in this disclosure, including innovations in said stripper rubber 108.

Said internal taper 746 of said pressure trap 740 can tighten under pressure as said pressure trap 740 will enhance a seal with said internal surface 1202 under pressure.

In one embodiment, said multi-stage loading zones 726 can build its hold on a tubing within said stripper head assembly 100 by increasing the cross-section thickness of said stripper rubber 108 as said multi-stage loading zones 726 increase from a first stage 734 to a second stage 732 to a third stage 730 to a fourth stage 728, likewise, the relative angle of said fourth stage 728 and said second stage 732 convert pressure into inward force on tubing. Finally, pressure on said fourth stage 728 can assert pressure on said insert lower ring 406 and said one or more stalks 402 within said stripper rubber 108.

Figure 8:
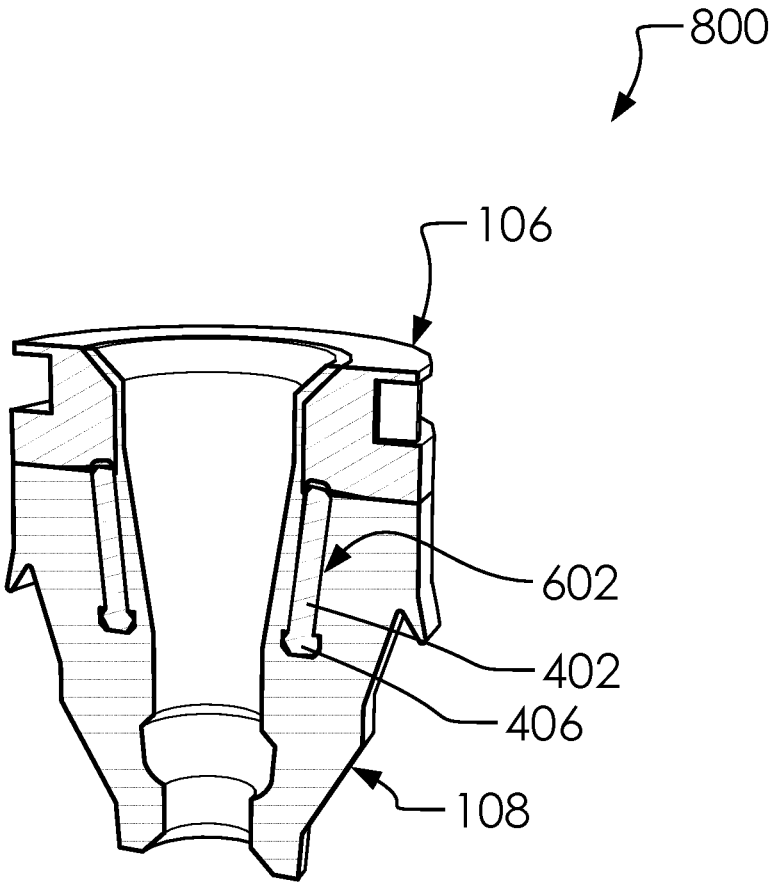
FIG. 8 illustrates a perspective overview view of said stripper insert 106 and said stripper rubber 108.

FIG. 8 illustrates a perspective overview view of said stripper insert 106 and said stripper rubber 108.

In one embodiment, an inner portions 800 can comprise said stripper insert 106 and said stripper rubber 108 attached to one another. In one embodiment, said inner portions 800 can be assembled by molding a portion of said stripper insert 106 into a portion of said stripper rubber 108. In one embodiment, a portion of said insert lower ring 406 and said one or more stalks 402 can be molded into said stalks aperture 602.

Figure 9:
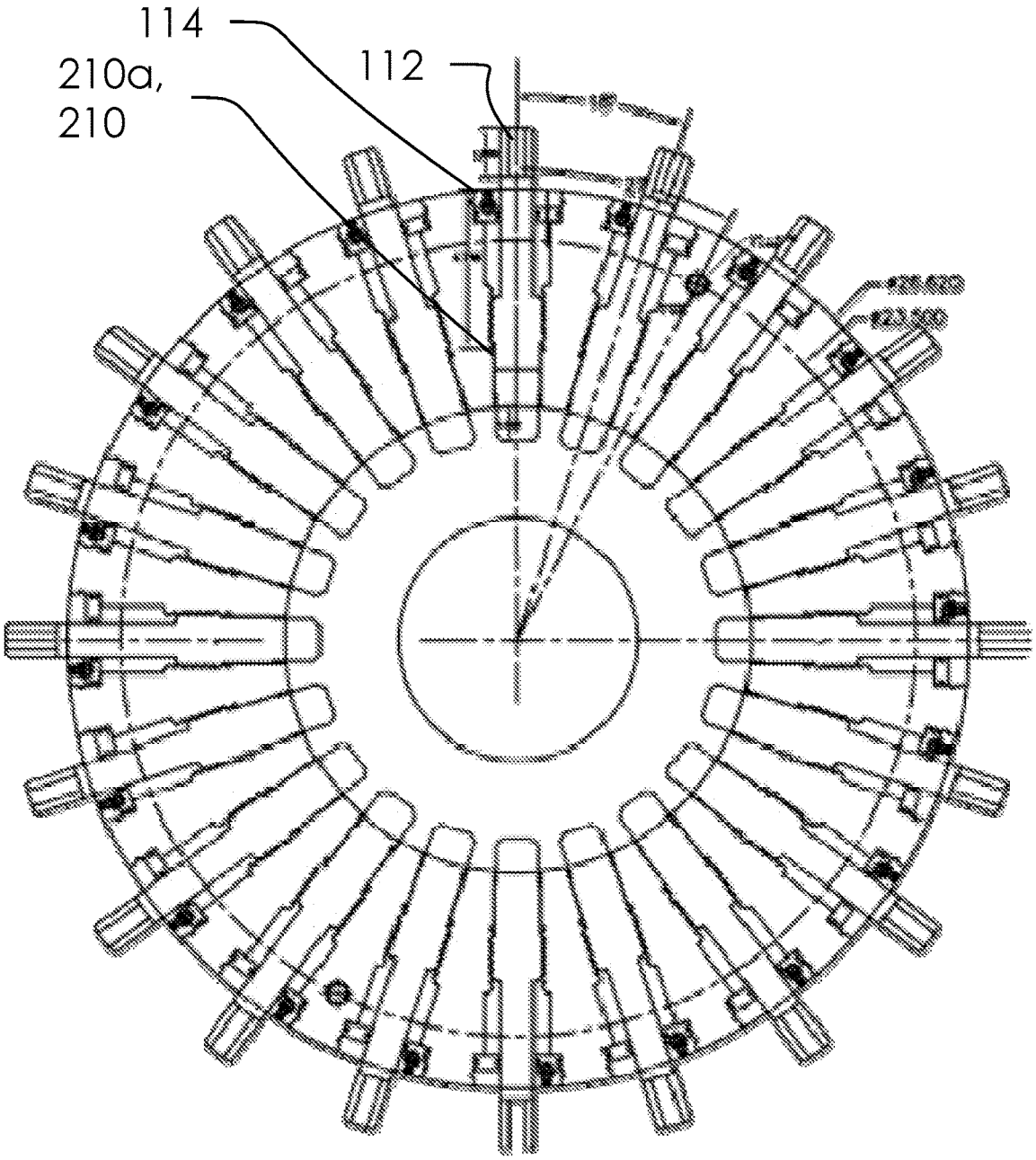
FIG. 9 illustrates an elevated top view of said stripper head assembly 100 with one or more retention pins 112 and one or more retention bushing assemblies 110 within one or more retention apertures 210.

FIG. 9 illustrates an elevated top view of said stripper head assembly 100 with said one or more retention pins 112 and said one or more retention bushing assemblies 110 within said one or more retention apertures 210.

In one embodiment, each among said one or more retention bushing assemblies 110 can comprise said one or more retention pins 112 and one or more retention bushings 902 attached within said one or more retention apertures 210.

In one embodiment, said one or more retention bushings 902 can comprise a first retention bushing 902*a*, a second retention bushing 902*b*, a third retention bushing 902*c*, a fourth retention bushing 902*d*, a fifth retention bushing 902*e*, a sixth retention bushing 902*f*, a seventh retention bushing 902*g*, an eighth retention bushing 902*h*, a ninth retention bushing 902*k*, and a tenth retention bushing 902*m*.

Figure 10A:
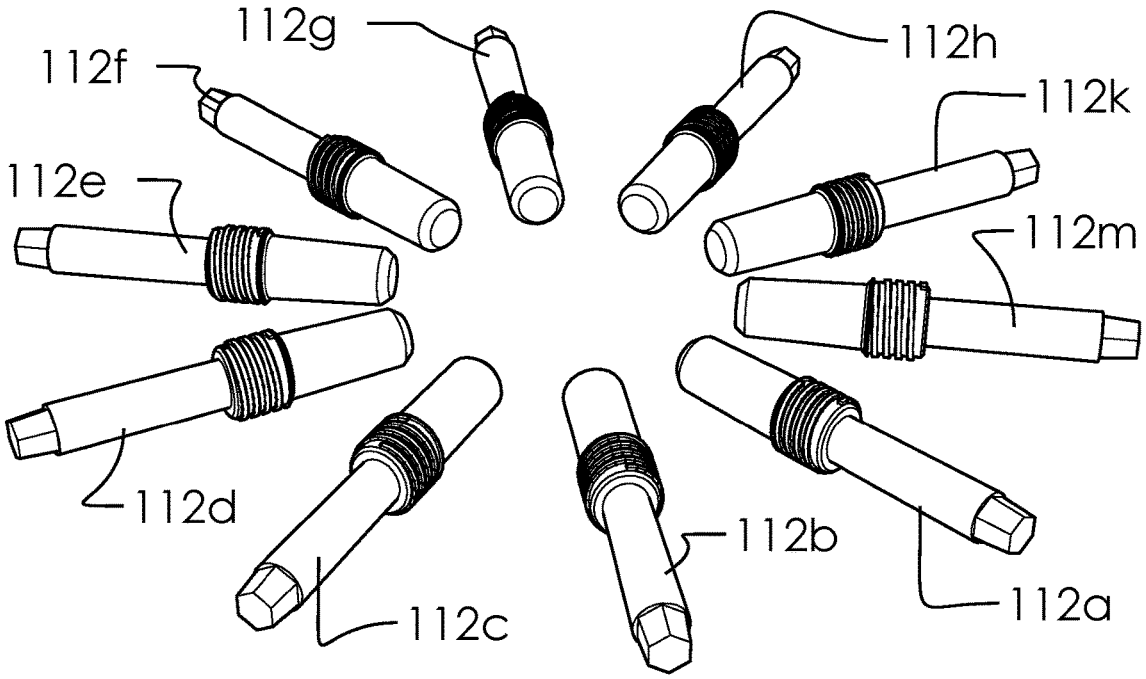
FIG. 10A illustrates a perspective overview view of said one or more retention bushing assemblies 110.
Figure 10B:
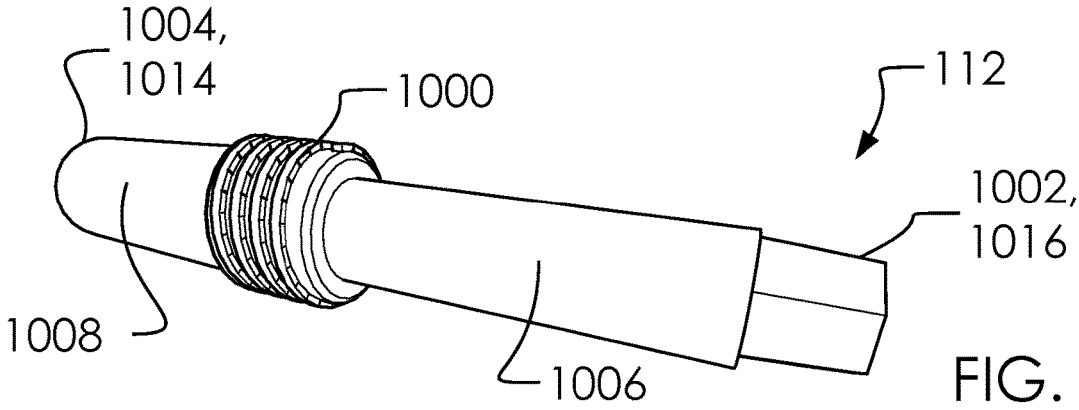
FIGS. 10B and 10C illustrate a perspective overview view of said one or more retention pins 112 and a cross-section view thereof.
Figure 10C:
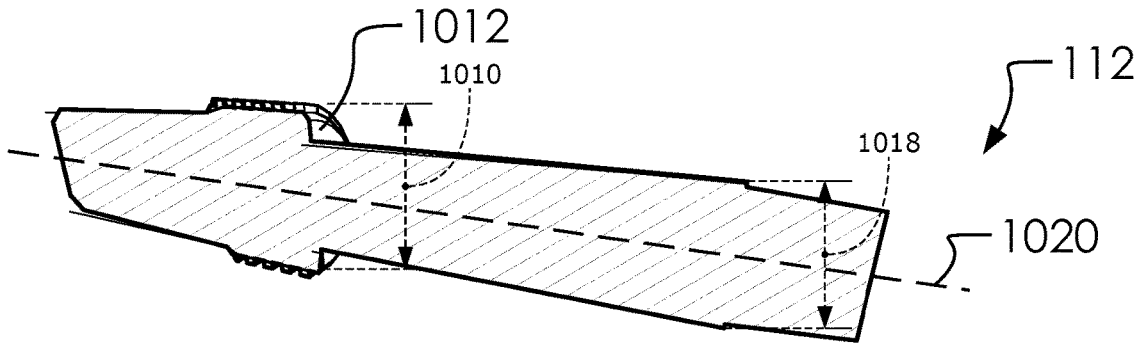

FIG. 10A illustrates a perspective overview view of said one or more retention bushing assemblies 110. FIGS. 10B and 10C illustrate a perspective overview vie w of said one or more retention pins 112 and a cross-section view thereof.

In one embodiment, each among said one or more retention pins 112 can comprise an external threading 1000, a drive head 1002, a pressing head 1004, a exterior portion body 1006, an interior portion body 1008, an interior end diameter 1010, a shoulder 1012, an internal end 1014, an external end 1016 and an exterior end diameter 1018.

Said external threading 1000 can be arranged between said internal end 1014 and said external end 1016. In one embodiment, said external threading 1000 can be on said interior portion body 1008 proximate to said shoulder 1012. In one embodiment, said interior end diameter 1010 can be larger than said exterior end diameter 1018; wherein, the step down in diameter between said interior end diameter 1010 and said exterior end diameter 1018 can create said shoulder 1012. In one embodiment, said internal end 1014 and said external end 1016 can be substantially cylindrical and aligned on a central axis 1020.

Said one or more retention pins 112 can comprise said drive head 1002 for attachment to a driving tool, such as a wrench. In one embodiment, said drive head 1002 can comprise a helical cross-section.

Figure 11A:
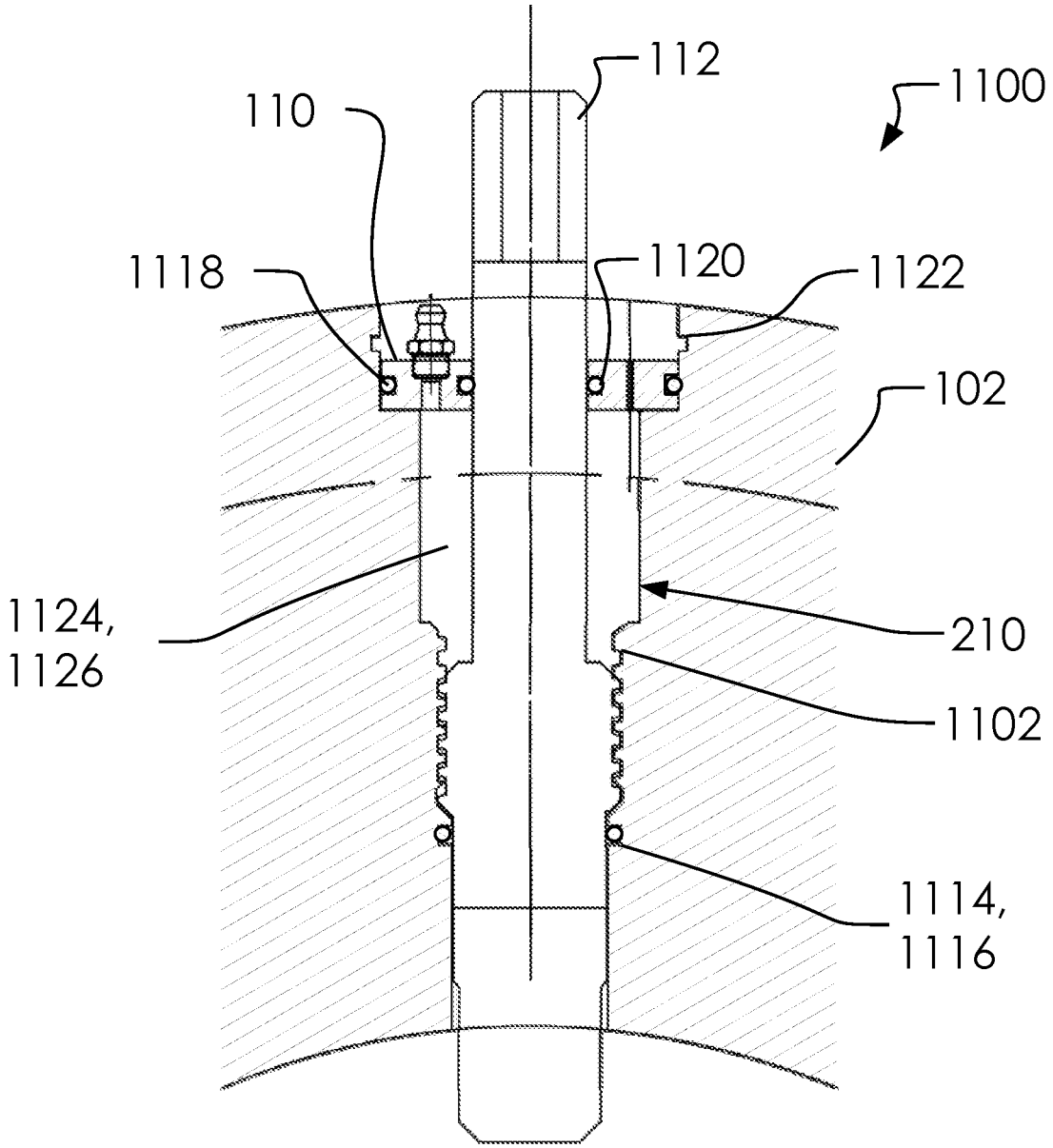
FIGS. 11A, and 11B illustrate an elevated top view of said one or more retention bushing assemblies 110 and said one or more retention pins 112 inserted into a stripper head 102, and an elevated top view of said one or more retention bushing assemblies 110.
Figure 11B:
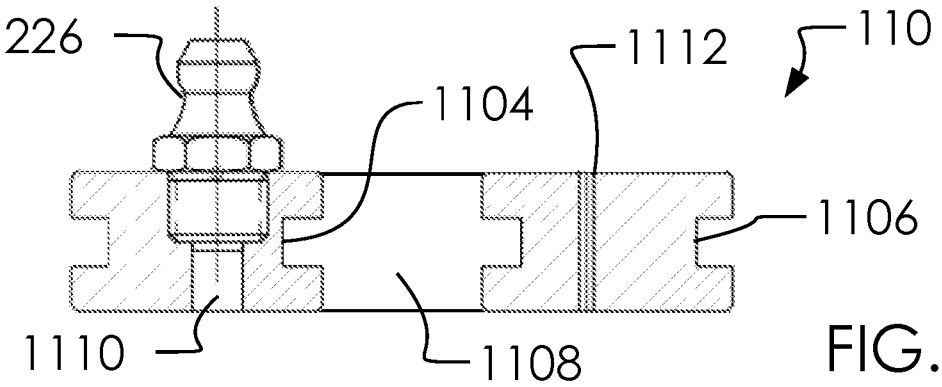

FIGS. 11A, and 11B illustrate an elevated top view of said one or more retention bushing assemblies 110 and said one or more retention pins 112 inserted into said stripper head 102, and an elevated top view of said one or more retention bushing assemblies 110.

Attached configuration 1100 can comprise said one or more retention bushing assemblies 110 and said one or more retention pins 112 inserted into said one or more retention apertures 210 of said stripper head 102.

In one embodiment, said one or more retention pins 112 can selectively slide into said one or more retention apertures 210 and selectively attach thereto by screwing said external threading 1000 into an internal threading 1102 of said one or more retention apertures 210.

In one embodiment, said one or more retention bushing assemblies 110 can comprise a ring comprising an interior O-ring groove 1104, an exterior O-ring groove 1106, a center aperture 1108, a grease aperture 1110, and a bleeder hole 1112.

Each among said one or more retention apertures 210 can further comprise an O-ring groove 1114 which can be configured to contain a first O-ring 1116 configured to seal a portion of said one or more retention pins 112 with said one or more retention apertures 210.

In one embodiment, said interior O-ring groove 1104 and said exterior O-ring groove 1106 can each be configured to contain a second O-ring 1118 and a third O-ring 1120, as illustrated. In one embodiment, said second O-ring 1118 can seat into said exterior O-ring groove 1106 and create a seal between said one or more retention bushing assemblies 110 and a portion of said stripper head 102; and said third O-ring 1120 can seat into said interior O-ring groove 1104 and create a seal between said one or more retention bushing assemblies 110 and a portion of said one or more retention pins 112.

In one embodiment, said one or more retention apertures 210 can further comprise a snap ring groove 1122, as illustrated, which can be configured to hold said one or more retention bushing assemblies 110 within said one or more retention apertures 210.

In one embodiment, a lubricant 1126 can be inserted into a retention pin cavity 1124 through said one or more grease ports 226 and said grease aperture 1110. In one embodiment, said lubricant 1126 (such as grease or other lubricants) can ensure parts of said one or more retention apertures 210 and said one or more retention pins 112 are protected from friction and heat.

Said retention pin cavity 1124 can comprise a cavity between portions of said one or more retention apertures 210 and said one or more retention pins 112.

Accordingly, said one or more retention bushing assemblies 110, said one or more retention pins 112 and said top portion 208 are engineered to allow said lubricant 1126 to be inserted into threading between said one or more retention bushing assemblies 110 and said one or more retention pins 112 without allowing said lubricant 1126 to spill inside of said stripper head 102.

Figure 12:
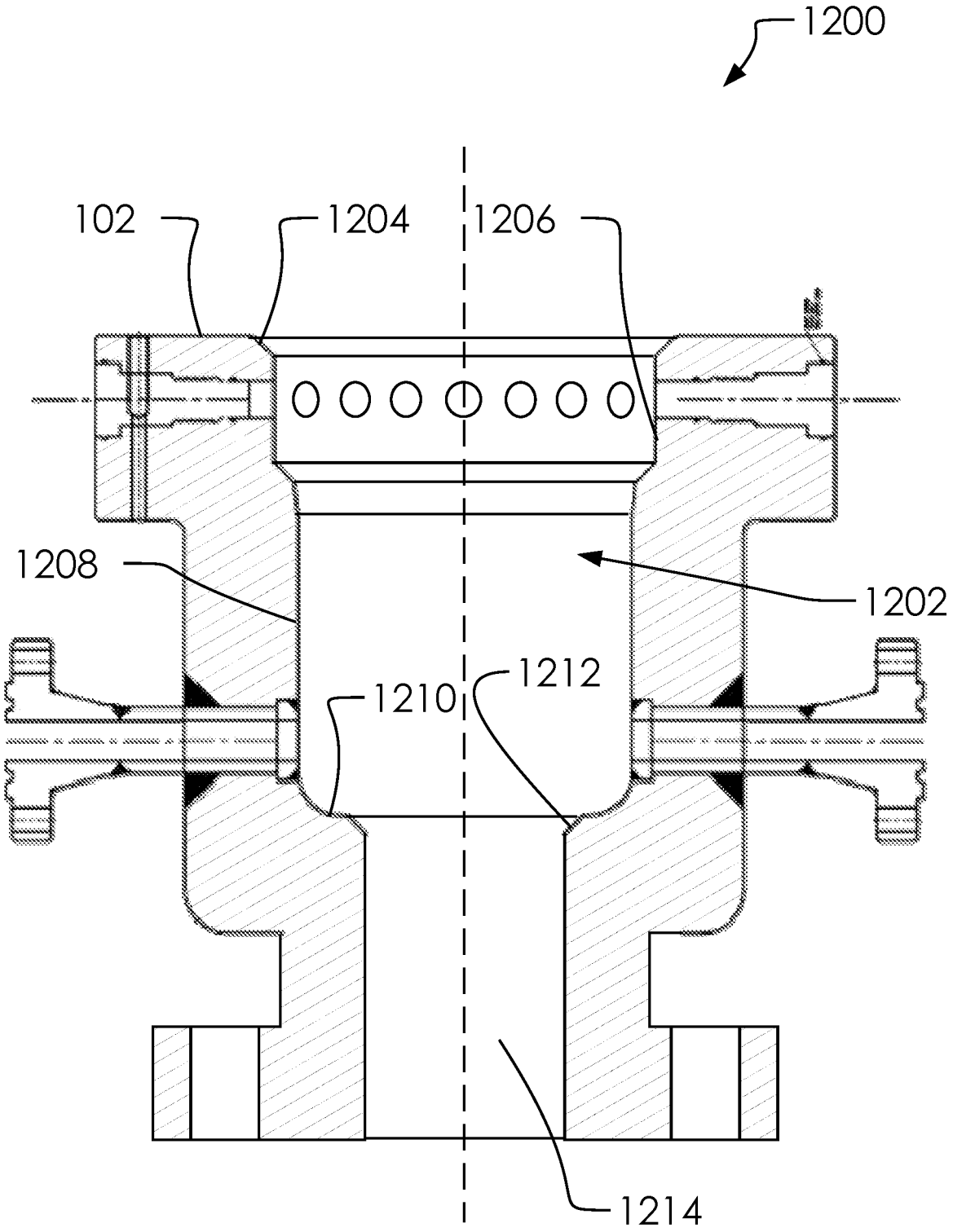
FIG. 12 illustrates a perspective overview view of said one or more retention pins 112.

FIG. 12 illustrates a perspective overview view of said one or more retention pins 112.

In one embodiment, said one or more retention bushing assemblies 110 can be welded into said stripper head 102 in said one or more retention apertures 210.

In one embodiment, said stripper head 102 can comprise said internal surface 1202. In one embodiment, said internal surface 1202 can progress (from to bottom) as: a beveled upper edge 1204, a first surface 1206, a second surface 1208, a third surface 1210, a lower beveled edge 1212 and a fourth surface 1214.

As is known in the art, said beveled upper edge 1204 can allow pipe and tubing to enter said stripper head assembly 100 so as to minimize damage to said stripper head assembly 100 or the tubing. Further, said collar portion 604 can be aligned above said beveled upper edge 1204 to further protect the equipment.

In one embodiment, said first surface 1206 can be slightly larger than said second surface 1208; wherein, said second surface 1208 can taper in so as to create a more solid seal between said stripper head 102 and said stripper rubber 108, as illustrated herein.

Said third surface 1210 can comprise a step inward and said lower beveled edge 1212 can be beveled, as illustrated. Finally, said fourth surface 1214 can be the smallest diameter of said internal surface 1202. In one embodiment, said fourth surface 1214 can fit with equipment mounted below said stripper head assembly 100.

Figure 13:
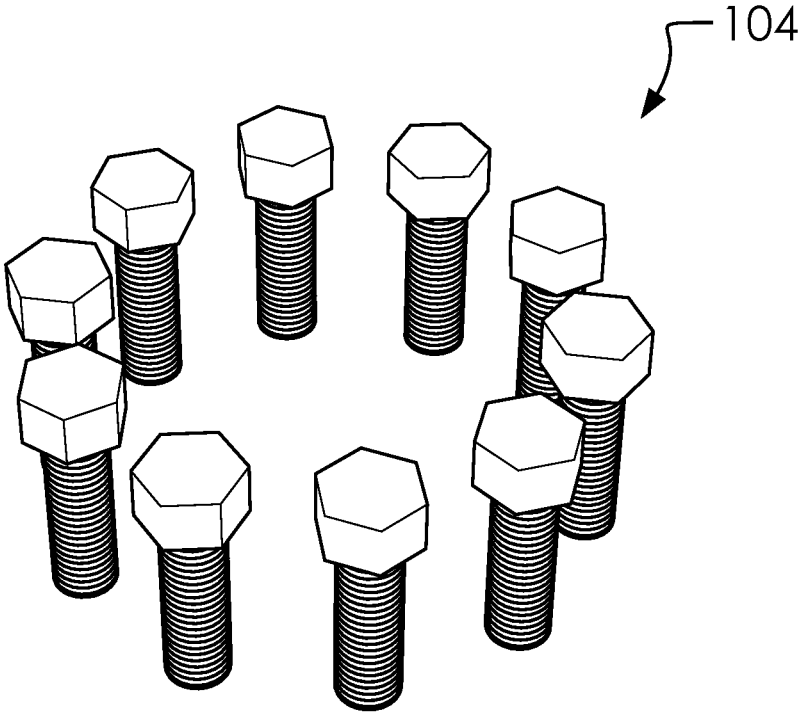
FIG. 13 illustrates a perspective overview view of said stripper head assembly 100 in cross-section view.

FIG. 13 illustrates a perspective overview view of said stripper head assembly 100 in cross-section view.

In one embodiment, said one or more bolts 104 can comprise API studs, as is known in the art.

Figure 14:
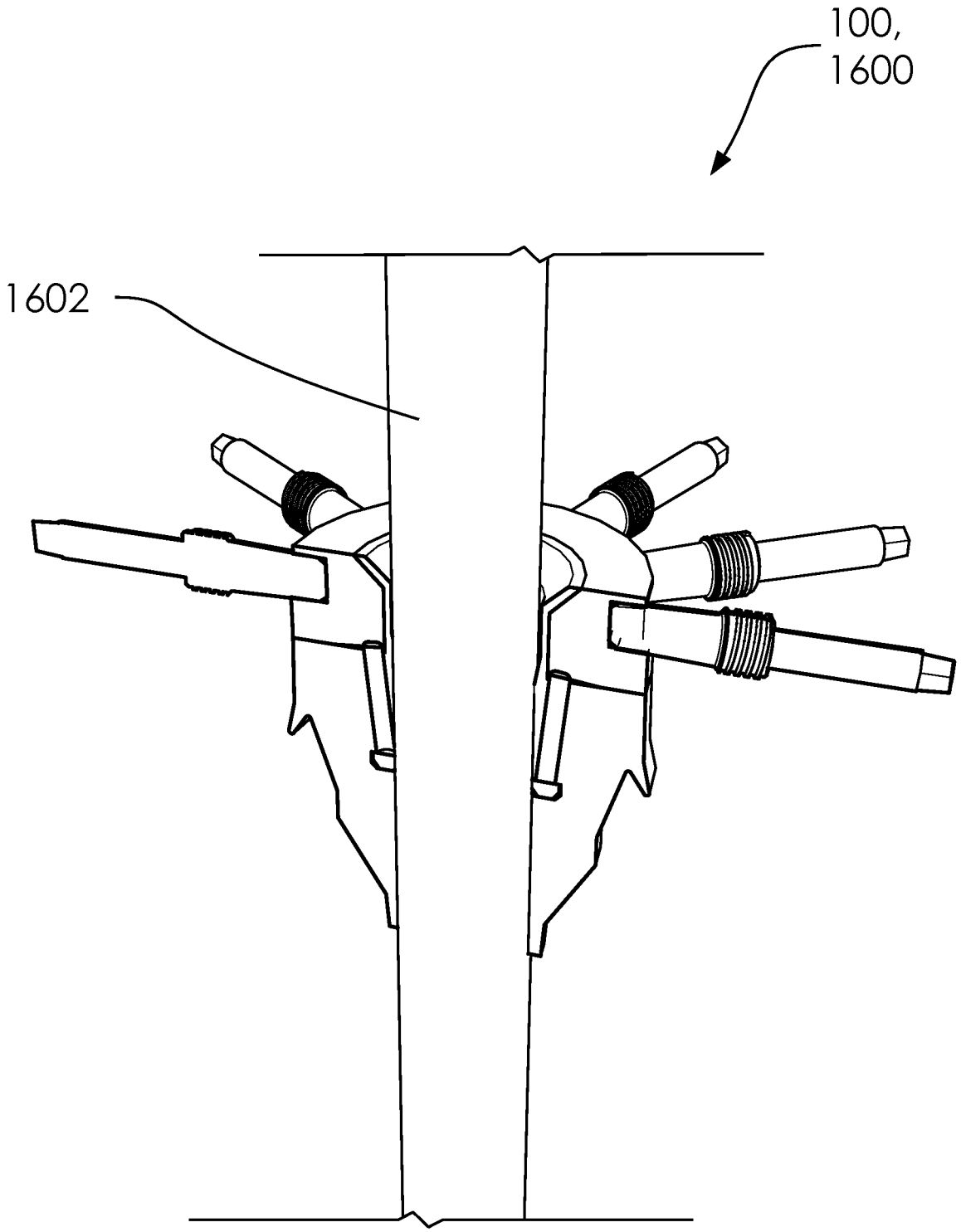
FIG. 14 illustrates a perspective overview of a pressurized well environment 1600 with a cross section overview of a portion of a work-string 1602 and a portion of said stripper head assembly 100.

FIG. 14 illustrates a perspective overview of a pressurized well environment 1600 with a cross section overview of a portion of a work-string 1602 and a portion of said stripper head assembly 100.

Figure 15:
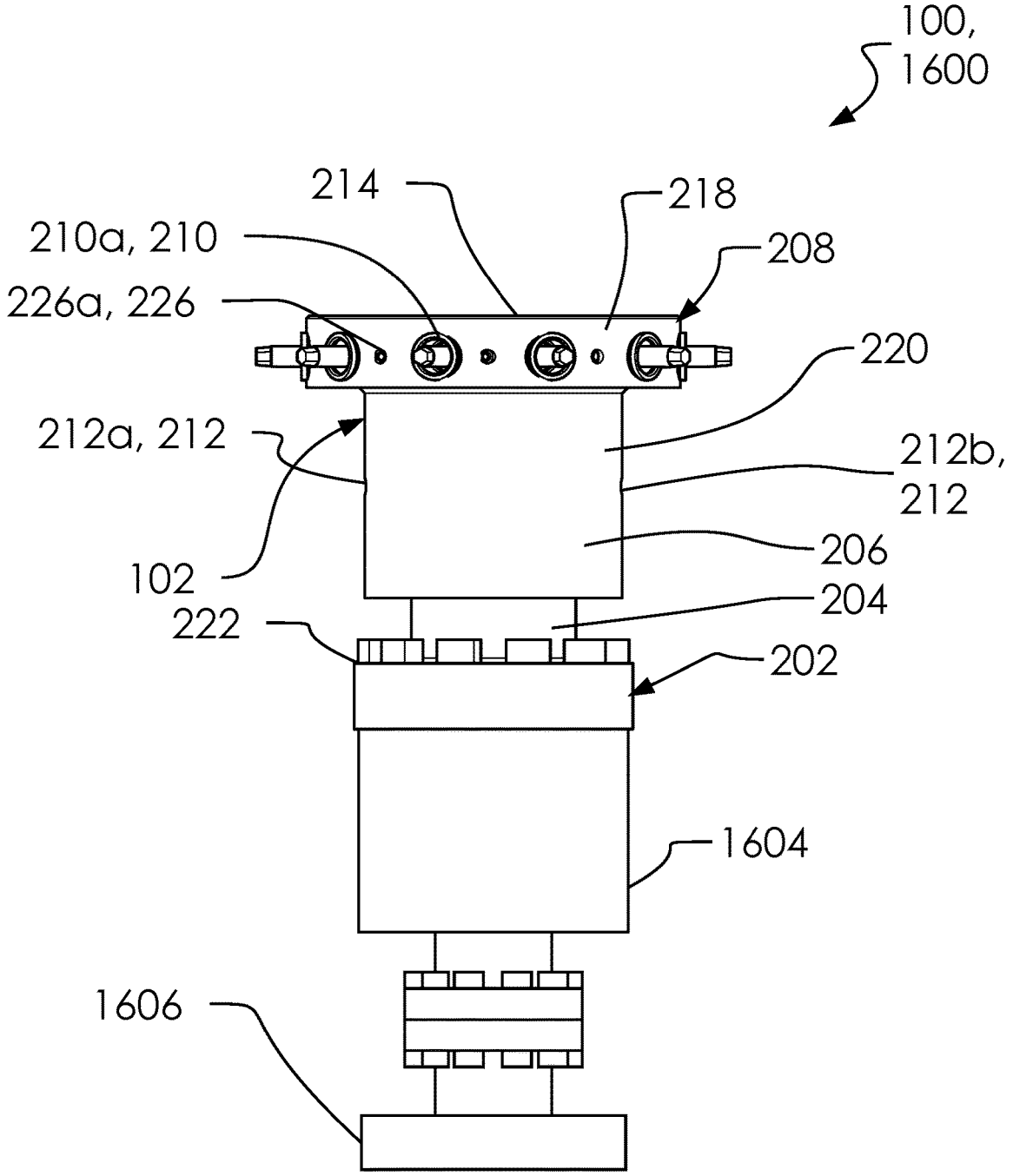
FIG. 15 illustrates an elevated side view of said stripper head assembly 100 in said pressurized well environment 1600.

FIG. 15 illustrates an elevated side view of said stripper head assembly 100 in said pressurized well environment 1600.

In one embodiment said stripper head assembly 100 can attach to a blow-out preventer 1604 which is attached to a well head 1606.

The following listing of the parts in the specification is included for ease of reading this specification:

said stripper head assembly 100,
said stripper head 102,
said one or more bolts 104,
said first bolt 104*a*,
said second bolt 104*b*,
said third bolt 104*c*,
said fourth bolt 104*d*,
said fifth bolt 104*e*,
said sixth bolt 104*f*,
said seventh bolt 104*g*,
said eighth bolt 104*h*,
said ninth bolt 104*k*,
said tenth bolt 104*m*,
said stripper insert 106,
said stripper rubber 108,
said one or more retention bushing assemblies 110,
said first retention bushing assembly 110*a*,
said second retention bushing assembly 110*b*,
said third retention bushing assembly 110*c*,
said fourth retention bushing assembly 110*d*,
said fifth retention bushing assembly 110*e*,
said sixth retention bushing assembly 110*f*,
said seventh retention bushing assembly 110*g*,
said eighth retention bushing assembly 110*h*,
said ninth retention bushing assembly 110*k*,
said tenth retention bushing assembly 110*m*,
said one or more retention pins 112,
said first retention pin 112*a*,
said second retention pin 112*b*,
said third retention pin 112*c*,
said fourth retention pin 112*d*,
said fifth retention pin 112*e*,
said sixth retention pin 112*f*,
said seventh retention pin 112*g*,
said eighth retention pin 112*h*,
said ninth retention pin 112*k*,
said tenth retention pin 112*m*,
said one or more mating apertures 114,
said first mating aperture 114*a*,
said second mating aperture 114*b*,
said third mating aperture 114*c*,
said fourth mating aperture 114*d*,
said fifth mating aperture 114*e*,
said sixth mating aperture 114*f*,
said seventh mating aperture 114*g*,
said eighth mating aperture 114*h*,
said ninth mating aperture 114*k*,
said tenth mating aperture 114*m*,
said flange base 202,
said lower neck portion 204,
said body portion 206,
said top portion 208,
said one or more retention apertures 210,
said first retention aperture 210*a*,
said second retention aperture 210*b*,
said third retention aperture 210*c*,
said fourth retention aperture 210*d*,
said fifth retention aperture 210*e*,
said sixth retention aperture 210*f*,
said seventh retention aperture 210*g*,
said eighth retention aperture 210*h*,
said ninth retention aperture 210*k*,
said tenth retention aperture 210*m*,
said one or more flanged outlets 212,
said first flanged outlet 212*a*,
said second flanged outlet 212*b*,
said top surface 214,
said bottom surface 216,
said side surface 220,
said top surface 222,
said center aperture 224,
said one or more grease ports 226,
said first grease port 226*a*,
said second grease port 226*b*,
said third grease port 226*c*,
said fourth grease port 226*d*,
said fifth grease port 226*e*,
said sixth grease port 226*f*,
said seventh grease port 226*g*,
said eighth grease port 226*h*,
said ninth grease port 226*k*,
said tenth grease port 226*m*,
said insert upper ring 400,
said one or more stalks 402,
said first stalk 402*a*,
said second stalk 402*b*,
said third stalk 402*c*,
said fourth stalk 402*d*,
said fifth stalk 402*e*,
said sixth stalk 402*f*,
said seventh stalk 402*g*,
said eighth stalk 402*h*,
said anti-rotation tab 404,
said insert lower ring 406,
said center aperture 408,
said beveled interior edge 502,
said upper portion 504,
said lower portion 506,
said indention 508,
said outer sidewall 514,
said top surface 516,
said bottom surface 518,
said inner sidewall 520,
said height 522,
said external diameter 526,
said internal diameter 528,
said inner sidewall 530,
said height 532,
said depth 534,
said stalk angle 536,
said center aperture 600,
said stalks aperture 602,
said collar portion 604,
said upper mid portion 606,
said lower mid portion 608,
said lower portions 610,
said seal lip 702,
said inner surface 706,
said lubrication groove 714,
said lower aperture 716,
said upper aperture 718,
said diameter 720,
said multi-stage loading zones 726,
said fourth stage 728,
said third stage 730,
said second stage 732,
said first stage 734,
said shoulder 738,
said pressure trap 740, said central aperture 744,
said internal taper 746,
said inner portions 800,
one or more retention pin apertures 900,
a first retention pin aperture 900*a*,
a second retention pin aperture 900*b*,
a third retention pin aperture 900*c*,
a fourth retention pin aperture 900*d*,
a fifth retention pin aperture 900*e*,
a sixth retention pin aperture 900*f*,
a seventh retention pin aperture 900*g*,
an eighth retention pin aperture 900*h*,
a ninth retention pin aperture 900*k*,
a tenth retention pin aperture 900*m*,
said one or more retention bushings 902,
said first retention bushing 902*a*,
said second retention bushing 902*b*,
said third retention bushing 902*c*,
said fourth retention bushing 902*d*,
said fifth retention bushing 902*e*,
said sixth retention bushing 902*f*,
said seventh retention bushing 902*g*,
said eighth retention bushing 902*h*,
said ninth retention bushing 902*k*,
said tenth retention bushing 902*m*,
said external threading 1000,
said drive head 1002,
said pressing head 1004,
said exterior portion body 1006,
said interior portion body 1008,
said interior end diameter 1010,
said shoulder 1012,
said internal end 1014,
said external end 1016,
said exterior end diameter 1018,
said central axis 1020,
said attached configuration 1100,
said internal threading 1102,
said interior O-ring groove 1104,
said exterior O-ring groove 1106,
said center aperture 1108,
said grease aperture 1110,
said bleeder hole 1112,
said O-ring groove 1114,
said first O-ring 1116,
said second O-ring 1118,
said third O-ring 1120,
said snap ring groove 1122,
said retention pin cavity 1124,
said lubricant 1126,
said internal surface 1202,
said beveled upper edge 1204,
said first surface 1206,
said second surface 1208,
said third surface 1210,
said lower beveled edge 1212,
said fourth surface 1214,
said pressurized well environment 1600,
said work-string 1602,
said blow-out preventer 1604, and
said well head 1606.

The following sentences are a restatement of the original claims and are included to ensure a complete disclosure and matching claims:

Said stripper head assembly 100 for holding back pressure while stripping said work-string 1602 in and out of said pressurized well environment 1600. Said stripper head assembly 100 comprises said stripper head 102, said stripper insert 106, said stripper rubber 108, said one or more retention bushing assemblies 110, said one or more retention pins 112, and said one or more retention apertures 210. Said stripper head 102 comprises an outer portion of said stripper head assembly 100. Said stripper head 102 comprises, from top to bottom, said top portion 208, said body portion 206, said lower neck portion 204 and said flange base 202. a portion of said stripper insert 106 fits within a portion of said stripper rubber 108. a portion of said stripper rubber 108 fits within a portion of said stripper head 102. a portion of said one or more bolts 104 attach said flange base 202 of said stripper head assembly 100 equipment attached to said well head 1606 at said pressurized well environment 1600, such as said blow-out preventer 1604. Said stripper rubber 108 comprises a rubber material. Each among said one or more retention bushing assemblies 110 can be configured to seal said retention pin cavity 1124 within said one or more retention apertures 210 and around a portion of said one or more retention pins 112. Said one or more retention pins 112 can be configured to hold said stripper head assembly 100 in place relative to said work-string 1602. Each among said one or more retention bushing assemblies 110 comprises said one or more retention bushings 902, said one or more grease ports 226, and said bleeder hole 1112. Said bleeder hole 1112 allow a portion of said lubricant 1126 within said retention pin cavity 1124 to selectively escape at a given pressure. Said one or more grease ports 226 can be configured to selectively receive said lubricant 1126 into said retention pin cavity 1124. Each among said one or more retention bushings 902 comprises a ring comprising said interior O-ring groove 1104, said exterior O-ring groove 1106, said center aperture 1108, said grease aperture 1110, and said bleeder hole 1112. Said interior O-ring groove 1104 and said exterior O-ring groove 1106 can be configured to each be configured to contain said second O-ring 1118 and said third O-ring 1120, as illustrated. Said second O-ring 1118 can be configured to seat into said exterior O-ring groove 1106 and create a seal between said one or more retention bushing assemblies 110 and a portion of said stripper head 102. Said third O-ring 1120 can be configured to seat into said interior O-ring groove 1104 and create a seal between said one or more retention bushing assemblies 110 and a portion of said one or more retention pins 112.

Said stripper head assembly 100 for holding back pressure while stripping said work-string 1602 in and out of said pressurized well environment 1600. Said stripper head assembly 100 comprises said stripper head 102, said stripper insert 106, said stripper rubber 108, said one or more retention bushing assemblies 110, said one or more retention pins 112, and said one or more retention apertures 210. Said stripper head 102 comprises an outer portion of said stripper head assembly 100. Said stripper head 102 comprises, from top to bottom, said top portion 208, said body portion 206, said lower neck portion 204 and said flange base 202. a portion of said stripper insert 106 fits within a portion of said stripper rubber 108. a portion of said stripper rubber 108 fits within a portion of said stripper head 102. a portion of said one or more bolts 104 attach said flange base 202 of said stripper head assembly 100 equipment attached to said well head 1606 at said pressurized well environment 1600, such as said blow-out preventer 1604. Said stripper rubber 108 comprises a rubber material. Each among said one or more retention bushing assemblies 110 can be configured to seal said retention pin cavity 1124 within said one or more retention apertures 210 and around a portion of said one or more retention pins 112. Said one or more retention pins 112 can be configured to hold said stripper head assembly 100 in place relative to said work-string 1602.

Each among said one or more retention bushing assemblies 110 comprises said one or more retention bushings 902, said one or more grease ports 226, and said bleeder hole 1112. Said bleeder hole 1112 allow a portion of said lubricant 1126 within said retention pin cavity 1124 to selectively escape at a given pressure. Said one or more grease ports 226 can be configured to selectively receive said lubricant 1126 into said retention pin cavity 1124.

Each among said one or more retention bushings 902 comprises a ring comprising said interior O-ring groove 1104, said exterior O-ring groove 1106, said center aperture 1108, said grease aperture 1110, and said bleeder hole 1112. Said interior O-ring groove 1104 and said exterior O-ring groove 1106 can be configured to each be configured to contain said second O-ring 1118 and said third O-ring 1120, as illustrated. Said second O-ring 1118 can be configured to seat into said exterior O-ring groove 1106 and create a seal between said one or more retention bushing assemblies 110 and a portion of said stripper head 102. Said third O-ring 1120 can be configured to seat into said interior O-ring groove 1104 and create a seal between said one or more retention bushing assemblies 110 and a portion of said one or more retention pins 112.

Each among said one or more retention apertures 210 can be configured to further comprise said O-ring groove 1114 which can be configured to contain said first O-ring 1116 configured to seal a portion of said one or more retention pins 112 with said one or more retention apertures 210.

Said one or more retention apertures 210 can be configured to further comprise said snap ring groove 1122 which can be configured to hold said one or more retention bushing assemblies 110 within said one or more retention apertures 210.

Each among said one or more retention bushing assemblies 110 can comprise said one or more grease ports 226. Each said one or more retention apertures 210 can comprise said retention pin cavity 1124. Said retention pin cavity 1124 comprises a cavity between portions of said one or more retention apertures 210 and said one or more retention pins 112. Said one or more grease ports 226 can be configured to receive said lubricant 1126. Said lubricant 1126 can be inserted into said retention pin cavity 1124 through said one or more grease ports 226. Said lubricant 1126 can be configured to lubricate parts of said one or more retention apertures 210 and said one or more retention pins 112 can be protected from friction and heat.

Said stripper rubber 108 comprises a form fitting element for use within said stripper head assembly 100. Said stripper rubber 108 comprises said lower aperture 716 and said upper aperture 718 at either end of said center aperture 600. Said stripper rubber 108 comprises said inner surface 706 around an interior space comprising said center aperture 600. Said stripper rubber 108 comprises said collar portion 604 attaching to said upper mid portion 606. Said upper mid portion 606 comprises a substantially cylindrical hollow element for selectively being held within said inner sidewall 520 of said stripper insert 106. Said lower portions 610 of said upper mid portion 606 extend down toward said lower aperture 716 and forming said multi-stage loading zones 726, and said multi-stage loading zones 726 can be configured to directing pressures to enhance the seal of said stripper rubber 108 within said stripper head assembly 100.

Said stripper head assembly 100 comprises several components which selectively nest within one another. A portion of said stripper insert 106 can be configured to fit within a portion of said stripper rubber 108. a portion of said stripper rubber 108 can be configured to fit within a portion of said stripper head 102. a portion of said one or more bolts 104 can be configured to attach to a portion of said stripper head 102. a portion of said one or more retention bushing assemblies 110 fit within a portion of said stripper head 102. a portion of said one or more retention pins 112 fit within a portion of said one or more retention bushing assemblies 110.

Said stripper insert 106 can be molded into said stripper rubber 108 and bonded together through an injected rubber molding process.

Said stripper insert 106 comprises said insert upper ring 400, said one or more stalks 402, and said insert lower ring 406. Said stripper insert 106 can be configured to fit within a portion of said stripper rubber 108. wherein, said one or more stalks 402 and said insert lower ring 406 can be configured to nest within said stripper rubber 108. Said one or more stalks 402 comprises cylindrical elements expending down from a lower portion of said insert upper ring 400. Said insert lower ring 406 comprises a portion of said insert upper ring 400 having been cut away. Said insert lower ring 406 comprises a substantially circular element adapted to prevent movement of said stripper insert 106 relative to said stripper rubber 108 once attached thereto.

Said insert upper ring 400 comprises said anti-rotation tab 404 adapted to prevent rotation of said stripper insert 106 with a portion of said one or more retention pins 112 inserted into a portion of said insert upper ring 400. Said anti-rotation tab 404 can be inserted into a portion of said indention 508 to block off a portion of said indention 508. a plurality of said anti-rotation tab 404 can be used, as needed. Said anti-rotation tab 404 can be welded into a portion of said indention 508.

Said stripper rubber 108 comprises a form fitting element for use within said stripper head assembly 100 being defined with said lower aperture 716 and said upper aperture 718 at either end of said center aperture 600. Said inner surface 706 around an interior space comprising said center aperture 600. Said collar portion 604 attaching to said upper mid portion 606. Said upper mid portion 606 comprising a substantially cylindrical hollow element for selectively being held within said inner sidewall 520 of said stripper insert 106. Said lubrication groove 714 cut into a portion of said lower portions 610. Said shoulder 738 extending out from said upper mid portion 606 to form said lower mid portion 608. Said seal lip 702 comprising an outwardly extending material comprising said pressure trap 740 between said lower mid portion 608 and said lower portions 610. Said lower portions 610 extending down toward said lower aperture 716 and forming said multi-stage loading zones 726. Said multi-stage loading zones 726 configured to directing pressures so as to enhance the seal of said stripper rubber 108 within said stripper head assembly 100.

Said pressure trap 740 comprises said internal taper 746. Said internal taper 746 can be configured to create an early seal with said internal surface 1202 of said stripper head 102. n this manner, said pressure trap 740 can be self-energized to press said seal lip 702 into said internal surface 1202. Said seal lip 702 can be configured to have enough initial contact to create the initial seal which can be configured to then hold. self-energized can be configured to mean that said stripper rubber 108 need not be compressed or squeezed at installation to create the initial seal, rather it need only be inserted into said stripper head 102. Said internal taper 746 of said pressure trap 740 can be configured to tighten under pressure as said pressure trap 740 will enhance a seal with said internal surface 1202 under pressure.

Said internal taper 746 of said pressure trap 740 can be configured to tighten under pressure as said pressure trap 740 will enhance a seal with said internal surface 1202 under pressure. Said multi-stage loading zones 726 can be configured to build its hold on a tubing within said stripper head assembly 100 by increasing the cross-section thickness of said stripper rubber 108 as said multi-stage loading zones 726 increase from said first stage 734 to said second stage 732 to said third stage 730 to said fourth stage 728. likewise, the relative angle of said fourth stage 728 and said second stage 732 convert pressure into inward force on tubing. pressure on said fourth stage 728 can be configured to assert pressure on said insert lower ring 406 and said one or more stalks 402 within said stripper rubber 108.

Said one or more retention pins 112 can be configured to selectively slide into said one or more retention apertures 210 and selectively attach thereto by screwing said external threading 1000 of said one or more retention pins 112 into said internal threading 1102 of said one or more retention apertures 210.

Said stripper head assembly 100 for holding back pressure while stripping said work-string 1602 in and out of said pressurized well environment 1600. Said stripper head assembly 100 comprises said stripper head 102, said stripper insert 106, said stripper rubber 108, said one or more retention bushing assemblies 110, said one or more retention pins 112, and said one or more retention apertures 210. Said stripper head 102 comprises an outer portion of said stripper head assembly 100. Said stripper head 102 comprises, from top to bottom, said top portion 208, said body portion 206, said lower neck portion 204 and said flange base 202. a portion of said stripper insert 106 fits within a portion of said stripper rubber 108. a portion of said stripper rubber 108 fits within a portion of said stripper head 102. a portion of said one or more bolts 104 attach said flange base 202 of said stripper head assembly 100 equipment attached to said well head 1606 at said pressurized well environment 1600, such as said blow-out preventer 1604. Said stripper rubber 108 comprises a rubber material. Each among said one or more retention bushing assemblies 110 can be configured to seal said retention pin cavity 1124 within said one or more retention apertures 210 and around a portion of said one or more retention pins 112. Said one or more retention pins 112 can be configured to hold said stripper head assembly 100 in place relative to said work-string 1602. Each among said one or more retention bushing assemblies 110 comprises said one or more retention bushings 902. Each among said one or more retention bushings 902 comprises a ring comprising said interior O-ring groove 1104, said exterior O-ring groove 1106, said center aperture 1108. Said interior O-ring groove 1104 and said exterior O-ring groove 1106 can be configured to each be configured to contain said second O-ring 1118 and said third O-ring 1120, as illustrated. Said second O-ring 1118 can be configured to seat into said exterior O-ring groove 1106 and create a seal between said one or more retention bushing assemblies 110 and a portion of said stripper head 102. Said third O-ring 1120 can be configured to seat into said interior O-ring groove 1104 and create a seal between said one or more retention bushing assemblies 110 and a portion of said one or more retention pins 112. Said one or more retention pins 112 can be configured to selectively slide into said one or more retention apertures 210 and selectively attach thereto by screwing said external threading 1000 of said one or more retention pins 112 into said internal threading 1102 of said one or more retention apertures 210.

Each among said one or more retention bushings 902 comprises a ring comprising said interior O-ring groove 1104, said exterior O-ring groove 1106, said center aperture 1108, said grease aperture 1110, and said bleeder hole 1112. Said interior O-ring groove 1104 and said exterior O-ring groove 1106 can be configured to each be configured to contain said second O-ring 1118 and said third O-ring 1120, as illustrated. Said second O-ring 1118 can be configured to seat into said exterior O-ring groove 1106 and create a seal between said one or more retention bushing assemblies 110 and a portion of said stripper head 102. Said third O-ring 1120 can be configured to seat into said interior O-ring groove 1104 and create a seal between said one or more retention bushing assemblies 110 and a portion of said one or more retention pins 112.

Each among said one or more retention apertures 210 can be configured to further comprise said O-ring groove 1114 which can be configured to contain said first O-ring 1116 configured to seal a portion of said one or more retention pins 112 with said one or more retention apertures 210.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A stripper head assembly for holding back pressure while stripping a work-string in and out of a pressurized well environment, wherein:

said stripper head assembly comprises a stripper head, a stripper insert, a stripper rubber, one or more retention bushing assemblies, one or more retention pins, and one or more retention apertures;

said stripper head comprises an outer portion of said stripper head assembly;

said stripper head comprises, from top to bottom, a top portion, a body portion, a lower neck portion and a flange base;

a portion of said stripper insert fits within a portion of said stripper rubber;

a portion of said stripper rubber fits within a portion of said stripper head;

a portion of one or more bolts attach said flange base of said stripper head assembly equipment attached to a well head at said pressurized well environment, such as a blow-out preventer;

said stripper rubber comprises a rubber material;

each among said one or more retention bushing assemblies are configured to seal a retention pin cavity within said one or more retention apertures and around a portion of said one or more retention pins;

said one or more retention pins are configured to hold said stripper head assembly in place relative to said work-string;

each among said one or more retention bushing assemblies comprises one or more retention bushings, one or more grease ports, and a bleeder hole;

said bleeder hole allows a portion of a lubricant within said retention pin cavity to selectively escape at a given pressure;

said one or more grease ports are configured to selectively receive said lubricant into said retention pin cavity;

each among said one or more retention bushings comprises a ring comprising an interior O-ring groove, an exterior O-ring groove, a center aperture, a grease aperture, and said bleeder hole;

said interior O-ring groove and said exterior O-ring groove is configured to each be configured to contain a second O-ring and a third O-ring;

said second O-ring is configured to seat into said exterior O-ring groove and create a seal between said one or more retention bushing assemblies and a portion of said stripper head; and said third O-ring is configured to seat into said interior O-ring groove and create a seal between said one or more retention bushing assemblies and a portion of said one or more retention pins.

2. The stripper head assembly of claim 1, wherein:

each among said one or more retention bushings comprises a ring comprising said interior O-ring groove, said exterior O-ring groove, said center aperture, a grease aperture, and a bleeder hole;

said interior O-ring groove and said exterior O-ring groove is configured to each be configured to contain said second O-ring and said third O-ring;

said second O-ring is configured to seat into said exterior O-ring groove and create a seal between said one or more retention bushing assemblies and a portion of said stripper head; and Said third O-ring is configured to seat into said interior O-ring groove and create a seal between said one or more retention bushing assemblies and a portion of said one or more retention pins.

3. The stripper head assembly of claim 2, wherein:

each among said one or more retention apertures are configured to further comprise an O-ring groove which is configured to contain a first O-ring configured to seal a portion of said one or more retention pins with said one or more retention apertures.

4. A stripper head assembly for holding back pressure while stripping a work-string in and out of a pressurized well environment, wherein:

said stripper head assembly comprises a stripper head, a stripper insert, a stripper rubber, one or more retention bushing assemblies, one or more retention pins, and one or more retention apertures;

said stripper head comprises an outer portion of said stripper head assembly;

said stripper head comprises, from top to bottom, a top portion, a body portion, a lower neck portion and a flange base;

a portion of said stripper insert fits within a portion of said stripper rubber;

a portion of said stripper rubber fits within a portion of said stripper head;

a portion of one or more bolts attach said flange base of said stripper head assembly equipment attached to a well head at said pressurized well environment, such as a blow-out preventer;

said stripper rubber comprises a rubber material;

each among said one or more retention bushing assemblies are configured to seal a retention pin cavity within said one or more retention apertures and around a portion of said one or more retention pins;

said one or more retention pins are configured to hold said stripper head assembly in place relative to said work-string;

each among said one or more retention bushing assemblies comprises one or more retention bushings, one or more grease ports, and a bleeder hole;

said bleeder hole allows a portion of a lubricant within said retention pin cavity to selectively escape at a given pressure; and said one or more grease ports are configured to selectively receive said lubricant into said retention pin cavity.

5. The stripper head assembly of claim 4, wherein:

each among said one or more retention bushings comprises a ring comprising an interior O-ring groove, an exterior O-ring groove, a center aperture, a grease aperture, and said bleeder hole;

said interior O-ring groove and said exterior O-ring groove is configured to each be configured to contain a second O-ring and a third O-ring;

said second O-ring is configured to seat into said exterior O-ring groove and create a seal between said one or more retention bushing assemblies and a portion of said stripper head; and said third O-ring is configured to seat into said interior O-ring groove and create a seal between said one or more retention bushing assemblies and a portion of said one or more retention pins.

6. The stripper head assembly of claim 5, wherein:

each among said one or more retention apertures are configured to further comprise an O-ring groove which is configured to contain a first O-ring configured to seal a portion of said one or more retention pins with said one or more retention apertures.

7. The stripper head assembly of claim 4, wherein:

said one or more retention apertures are configured to further comprise a snap ring groove which is configured to hold said one or more retention bushing assemblies within said one or more retention apertures.

8. The stripper head assembly of claim 4, wherein:

each among said one or more retention bushing assemblies comprise said one or more grease ports;

each said one or more retention apertures comprise said retention pin cavity;

said retention pin cavity comprises a cavity between portions of said one or more retention apertures and said one or more retention pins;

said one or more grease ports are configured to receive said lubricant;

said lubricant is inserted into said retention pin cavity through said one or more grease ports; and said lubricant is configured to lubricate parts of said one or more retention apertures and said one or more retention pins are protected from friction and heat.

9. The stripper head assembly of claim 4, wherein:

said stripper rubber comprises a form fitting element for use within said stripper head assembly;

said stripper rubber comprises a lower aperture and an upper aperture at either end of a center aperture;

said stripper rubber comprises an inner surface around an interior space comprising said center aperture;

said stripper rubber comprises a collar portion attaching to an upper mid portion;

said upper mid portion comprises a substantially cylindrical hollow element for selectively being held within an inner sidewall of said stripper insert;

a lower portions of said upper mid portion extend down toward said lower aperture and forming a multi-stage loading zones; and said multi-stage loading zones are configured to directing pressures to enhance the seal of said stripper rubber within said stripper head assembly.

10. The stripper head assembly of claim 4, wherein:

said stripper head assembly comprises several components which selectively nest within one another; wherein, a portion of said stripper insert is configured to fit within a portion of said stripper rubber;

a portion of said stripper rubber is configured to fit within a portion of said stripper head;

a portion of said one or more bolts are configured to attach to a portion of said stripper head;

a portion of said one or more retention bushing assemblies fit within a portion of said stripper head; and a portion of said one or more retention pins fit within a portion of said one or more retention bushing assemblies.

11. The stripper head assembly of claim 4, wherein:

a side surface of said stripper head comprises one or more flanged outlets; and said one or more flanged outlets are used for pressure equalization and bleed-off.

12. The stripper head assembly of claim/wherein:

said stripper insert is molded into said stripper rubber and bonded together through an injected rubber molding process.

13. The stripper head assembly of claim 4, wherein:

said stripper insert comprises an insert upper ring, one or more stalks, and an insert lower ring;

said stripper insert is configured to fit within a portion of said stripper rubber;

wherein, said one or more stalks and said insert lower ring is configured to nest within said stripper rubber;

said one or more stalks comprises cylindrical elements expending down from a lower portion of said insert upper ring;

said insert lower ring comprises a portion of said insert upper ring having been cut away; and said insert lower ring comprises a substantially circular element adapted to prevent movement of said stripper insert relative to said stripper rubber once attached thereto.

14. The stripper head assembly of claim 13, wherein:

said insert upper ring comprises an anti-rotation tab adapted to prevent rotation of said stripper insert with a portion of said one or more retention pins inserted into a portion of said insert upper ring;

said anti-rotation tab is inserted into a portion of an indention to block off a portion of said indention;

a plurality of said anti-rotation tab is used, as needed; and said anti-rotation tab is welded into a portion of said indention.

15. The stripper head assembly of claim 4, wherein:

said stripper rubber comprises a form fitting element for use within said stripper head assembly being defined with said lower aperture and said upper aperture at either end of said center aperture;

said inner surface around an interior space comprising said center aperture;

said collar portion attaching to said upper mid portion;

said upper mid portion comprising a substantially cylindrical hollow element for selectively being held within said inner sidewall of said stripper insert;

a lubrication groove cut into a portion of said lower portions;

a shoulder extending out from said upper mid portion to form a lower mid portion;

a seal lip comprising an outwardly extending material comprising a pressure trap between said lower mid portion and said lower portions;

said lower portions extending down toward said lower aperture and forming said multi-stage loading zones; and said multi-stage loading zones configured to directing pressures so as to enhance the seal of said stripper rubber within said stripper head assembly.

16. The stripper head assembly of claim 15, wherein:

said pressure trap comprises an internal taper;

said internal taper is configured to create an early seal with an internal surface of said stripper head;

n this manner, said pressure trap is self-energized to press said seal lip into said internal surface;

said seal lip is configured to have enough initial contact to create the initial seal which is configured to then hold;

self-energized is configured to mean that said stripper rubber need not be compressed or squeezed at installation to create the initial seal, rather it need only be inserted into said stripper head; and said internal taper of said pressure trap is configured to tighten under pressure as said pressure trap will enhance a seal with said internal surface under pressure.

17. The stripper head assembly of claim 16, wherein:

said internal taper of said pressure trap is configured to tighten under pressure as said pressure trap will enhance a seal with said internal surface under pressure;

said multi-stage loading zones are configured to build its hold on a tubing within said stripper head assembly by increasing the cross-section thickness of said stripper rubber as said multi-stage loading zones increase from a first stage to a second stage to a third stage to a fourth stage;

likewise, the relative angle of said fourth stage and said second stage convert pressure into inward force on tubing; and pressure on said fourth stage is configured to assert pressure on said insert lower ring and said one or more stalks within said stripper rubber.

18. The stripper head assembly of claim 4, wherein:

said one or more retention pins are configured to selectively slide into said one or more retention apertures and selectively attach thereto by screwing an external threading of said one or more retention pins into an internal threading of said one or more retention apertures.

19. A stripper head assembly for holding back pressure while stripping a work-string in and out of a pressurized well environment, wherein:

said stripper head assembly comprises a stripper head, a stripper insert, a stripper rubber, one or more retention bushing assemblies, one or more retention pins, and one or more retention apertures;

said stripper head comprises an outer portion of said stripper head assembly;

said stripper head comprises, from top to bottom, a top portion, a body portion, a lower neck portion and a flange base;

a portion of said stripper insert fits within a portion of said stripper rubber;

a portion of said stripper rubber fits within a portion of said stripper head;

a portion of one or more bolts attach said flange base of said stripper head assembly equipment attached to a well head at said pressurized well environment, such as a blow-out preventer;

said stripper rubber comprises a rubber material;

each among said one or more retention bushing assemblies are configured to seal a retention pin cavity within said one or more retention apertures and around a portion of said one or more retention pins;

each among said one or more retention bushing assemblies comprise said one or more grease ports;

each said one or more retention apertures comprise said retention pin cavity;

said retention pin cavity comprises a cavity between portions of said one or more retention apertures and said one or more retention pins;

said one or more grease ports are configured to receive said lubricant;

said lubricant is inserted into said retention pin cavity through said one or more grease ports; and said lubricant is configured to lubricate parts of said one or more retention apertures and said one or more retention pins are protected from friction and heat.

20. A stripper head assembly for holding back pressure while stripping a work-string in and out of a pressurized well environment, wherein:

said stripper head assembly comprises a stripper head, a stripper insert, a stripper rubber, one or more retention bushing assemblies, one or more retention pins, and one or more retention apertures;

said stripper head comprises an outer portion of said stripper head assembly;

said stripper head comprises, from top to bottom, a top portion, a body portion, a lower neck portion and a flange base;

a portion of said stripper insert fits within a portion of said stripper rubber;

a portion of said stripper rubber fits within a portion of said stripper head;

a portion of one or more bolts attach said flange base of said stripper head assembly equipment attached to a well head at said pressurized well environment, such as a blow-out preventer;

said stripper rubber comprises a rubber material;

each among said one or more retention bushing assemblies are configured to seal a retention pin cavity within said one or more retention apertures and around a portion of said one or more retention pins;

said stripper rubber comprises a form fitting element for use within said stripper head assembly;

said stripper rubber comprises a lower aperture and an upper aperture at either end of a center aperture;

said stripper rubber comprises an inner surface around an interior space comprising said center aperture;

said stripper rubber comprises a collar portion attaching to an upper mid portion;

said upper mid portion comprises a substantially cylindrical hollow element for selectively being held within an inner sidewall of said stripper insert;

a lower portions of said upper mid portion extend down toward said lower aperture and forming a multi-stage loading zones; and said multi-stage loading zones are configured to directing pressures to enhance the seal of said stripper rubber within said stripper head assembly.

* * * * *